US006062286A

United States Patent [19]

Koyama et al.

[11] Patent Number: 6,062,286

[45] Date of Patent: May 16, 2000

[54] CLUTCH MECHANISM OF COAT FILM TRANSFER TOOL AND COAT FILM TRANSFER TOOL

[75] Inventors: Kouhei Koyama, Kyoto; Shigeru Tamai, Ikeda, both of Japan

[73] Assignee: Seed Rubber Company Limited, Osaka, Japan

[21] Appl. No.: 09/102,633

[22] Filed: Jun. 23, 1998

[30] Foreign Application Priority Data

Sep. 12, 1997 [JP] Japan ..... 9-267968

[51] Int. Cl.[7] ..... B32B 31/00

[52] U.S. Cl. ..... 156/540; 156/577; 156/579; 118/257

[58] Field of Search ..... 156/540, 577, 156/579; 118/200, 257

[56] References Cited

U.S. PATENT DOCUMENTS

| | | | |
|---|---|---|---|
| 4,718,971 | 1/1988 | Summers | 156/540 |
| 5,150,851 | 9/1992 | Manusch et al. | 242/68.1 |
| 5,310,445 | 5/1994 | Tucker | 156/574 |
| 5,430,904 | 7/1995 | Ono et al. | 156/577 X |
| 5,499,877 | 3/1996 | Sakanishi et al. | 400/193 |
| 5,685,944 | 11/1997 | Nose et al. | 156/540 |
| 5,759,341 | 6/1998 | Kobayashi | 156/540 |
| 5,770,007 | 6/1998 | Czech et al. | 156/540 |
| 5,792,263 | 8/1998 | Koyama et al. | 118/257 |

*Primary Examiner*—Richard Crispino
*Assistant Examiner*—Sue A. Purvis
*Attorney, Agent, or Firm*—Arent Fox Kintner Plotkin & Kahn PLLC

[57] ABSTRACT

A clutch mechanism easy to manufacture, high in assembling precision, and simple and inexpensive in structure, in a automatic takeup coat film transfer tool. A tape core on which a coat film transfer tape is wound is held and supported from both sides in the axial direction by a payout rotary gear and a rewind button, and the tape core and payout rotary gear are frictionally engaged with each other in the rotating direction by force transmitting means making use of frictional force by thrust load. This power transmitting means is composed of plural engaging protrusions elastically deformable in the axial direction, provided integrally to the payout rotary gear, and these engaging protrusions are elastically engaged with the axial end of the tape core by a specified pressing force, by the axial engaging force of the payout rotary gear and rewind button.

21 Claims, 21 Drawing Sheets

CLUTCH MECHANISM OF COAT FILM TRANSFER TOOL AND COAT FILM TRANSFER TOOL

BACKGROUND OF THE INVENTION

1. Field of the Invention

The present invention relates to a clutch mechanism of a coat film transfer tool and a coat film transfer tool having such clutch mechanism, and more particularly to a clutch technology for synchronizing the payout speed and takeup speed of coat film transfer tape in payout reel and takeup reel, in a coat film transfer tool having mechanism for transferring a coat film such as corrective paint layer or adhesive layer on a coat film transformer tape onto a sheet of paper or the like, and collecting the coat film transfer tape automatically after use.

2. Description of the Related Art

An example of construction of this kind of coat film transfer tool is shown in FIG. 20, in which the transfer tool comprises a payout reel (c) containing a roll of a coat film transfer tape (b), and a takeup reel (d) for recovering the coat film transfer tape (b') after use, rotatably provided in a case (a) to be held and manipulated by one hand, and a coat film transfer head (f) for pressing the coat film transfer tape (b) to the transfer area is projecting from the end of the case (a). Both the reels (c), (d) are mutually linked through a linkage (g), and the takeup reel (d) is of an automatic takeup type. This linkage (g) is constructed such that engaged with gears (h), (i) provided outside of the reels (c), (d) are engaged with each other. When this coat film transfer tool is used as an erasing tool for correcting an error, the case (a) is held by one hand, and the coat film transfer tape (b) is tightly pressed against the correction area (transfer area) by a pressing section (j) of the head (f), while the case (a) is moved in a specified direction. As a result, the corrective paint layer on the coat film transfer tape (b) in the pressing section (j) of the head (f) is applied on the correction area to cover and erase the letter or the like, and the coat film transfer tape (b') after use is automatically taken up and recovered on the takeup reel (d).

In this case, as used repeatedly, the outside diameter of the coat film transfer tape (b) on the payout reel (c) decreases, while the outside diameter of the coat film transfer tape (b') on the takeup reel (d) increases. On the other hand, the ratio of rotation of the payout reel (c) and takeup reel (d) (corresponding to the gear ratio of the linkage (g)) is always constant. Therefore, the takeup speed of the takeup reel (d) tends to be faster in the course of time as compared with the payout speed of the payout reel (c), and to prevent this, the payout speed and takeup speed must be synchronized. For this purpose, the payout reel (c) is provided with a clutch mechanism (k) for synchronizing the payout speed and takeup speed.

That is, in the payout reel (c), a boss (m) of a drive gear is rotatably supported on a support shaft (n), and a tape payout core (o) winding the coat film transfer tape (b) thereon is rotatably fitted in the boss (m), and the clutch mechanism (k) is disposed between the boss (m) and tape payout core (o).

This clutch mechanism (k) includes clutch pawls (p), (q) elastically deformable in the radial direction disposed on the outer circumference of the boss (m), which are elastically and detachably engaged with multiple catches (q), (q), . . . , provided in the inner circumference of the tape payout core (o)

When the takeup speed becomes relatively faster than the payout speed in the course of time, the synchronism of two speeds is broken and the rotary torque acting on the tape payout core (o) becomes large, the clutch mechanism (k) is actuated and the tape payout core (o) slips on the boss (m), so that the payout speed is synchronized with the takeup speed.

In such clutch mechanism (k), in the engaging and disengaging action between the clutch pawls (p), (q) and catches (q), (q), . . . , since elastic clicking sound is repeated intermittently, it may be uncomfortable for the user, and running of the coat film transfer tape (b) may be uneven, and this engaging and disengaging action becomes more frequent as the consumption is advanced and the difference between the payout speed and takeup speed becomes larger, and hence discomfort and uneven running become more and more obviously, and further improvements have been demanded.

In this regard, the present inventors previously proposed a clutch mechanism (r) as shown in FIG. 21 (see, for example, Japanese Laid-open Patent No. 5-58097). In this clutch mechanism (r), an elastic friction member (s) such as O-ring is interposed between the outer circumference of the boss (m) and the inner circumference of the tape payout core (o) in friction engaged state.

According to this clutch mechanism (r), in the synchronizing action, the three members (m), (s), (o) relatively slide smoothly, and so that discomfort and uneven running due to elastic and intermittent repeating actions can be eliminated.

In the structure of this clutch mechanism (r), however, since its force transmission makes use of frictional force by radial load among the three members (m), (s), (o), the designing and manufacturing conditions of the friction member (s) are very strict, and manufacture is difficult, which made it hard to lower the manufacturing cost.

That is, if the frictional force is too strong, the sense of manipulation tends to be too heavy in the latter half of the use. On the other hand, if the frictional force is too weak, the sense of manipulation tends to be too weak in the initial phase of use. Therefore, the frictional force must be set at an optimum value in consideration of such relation.

To obtain the optimum value of frictional force, when designing and manufacturing the friction member (s), its inside diameter and outside diameter must be respectively matched with the outer circumference of the boss (m) and the inner circumference of the tape payout core (o), and since the friction member (s) itself is also elastic, the thickness dimension of its radial direction must be also taken into consideration. Accordingly, after assembling the clutch mechanism (r), a process for fine adjustment of the shape and dimensions of the friction member (s) is additionally necessary.

Still more, since the diameter of the friction member (s) is set strictly, the friction member (s) must be assembled by force between the outer circumference of the boss (m) and the inner circumference of the tape payout core (o), and the assembling work is accompanied by much difficulty.

SUMMARY OF THE INVENTION

It is hence a primary object of the invention to present a new clutch mechanism eliminating the problems of the prior art.

It is other object of the invention to present a clutch mechanism, having a simple and inexpensive structure, in a coat film transfer tool of an automatic takeup type, easy to manufacture and capable of obtaining a high assembling precision, by making use of a frictional force by thrust load.

It is a different object of the invention to present a clutch mechanism having constituent members relatively sliding smoothly, in its synchronizing action, excellent in sense of manipulation, and free from uneven running.

It is a further object of the invention to present a clutch mechanism loose in designing and manufacturing conditions of its constituent members, easy to manufacture, and easy to assemble.

It is another object of the invention to present a clutch mechanism capable of lowering the manufacturing cost and also the device cost.

It is a further different object of the invention to present an inexpensive, automatic takeup type coat film transfer tool having such clutch mechanism, being simple in construction, small in the number of components, easy to manufacture, and high in assembling precision.

The clutch mechanism of the invention in such construction, relating to an automatic takeup type coat film transfer tool comprising a payout reel containing a roll of a coat film transfer tape, and a takeup reel for recovering the coat film transfer tape after use, rotatably provided in a case to be held and manipulated by one hand, with the takeup reel interlocking with the payout reel, is provided in at least one of the two reels, and is design to synchronize the payout speed and takeup speed of the coat film transfer tape between the two reels, in which the tape core on which the coat film transfer tape is wound is held and supported by and between a rotary drive unit for rotating and driving this tape core and an engaging support member to be engaged with the rotary drive unit in the axial direction, the tape core and rotary drive unit engaged with each other frictionally in the rotating direction by force transmitting means for making use of frictional force by thrust load, this force transmitting means comprises plural frictional members elastically deformable in the axial direction, provided in at least one of the rotary drive unit and engaging support member, and these frictional members are elastically engaged with the end surface in the axial direction of the tape core with a specified pressing force, by the axial engaging force of the rotary drive unit and engaging support member.

The construction of the coat film transfer tool of the invention comprises the above clutch mechanism, further comprises a case having shape and dimensions to be held and manipulated by one hand, a payout reel containing a roll of coat film transfer tape, provided rotatably in the case, a takeup reel for recovering the coat film transfer tape after use, provided rotatably in the case, a linkage for linking these reels so as to interlock with each other, and a coat film transfer head projecting from the front end of the case for pressing the coat film transfer tape onto the transfer area, and the clutch mechanism is provided in at least one of the two reels.

The coat film transfer tool having this clutch mechanism is available in disposable type to be discarded when the coat film transfer tape is used up, and refill type for replacing the coat film transfer tape after use with a new one.

In the coat film transfer tape of the invention, as the takeup speed of the takeup reel becomes gradually faster than the payout speed of the payout reel and their synchronism is broken, the rotary torque acting on the tape core for winding the coat film transfer tape is increased, but by the function of the clutch mechanism, the tape core slips and rotates against the rotary drive unit, and the rotary torque difference of the two is cleared, so that the payout speed is synchronized with the takeup speed.

In this case, since the tape core and rotary drive unit are frictionally engaged with each other in the rotating direction by the force transmitting means for making use of the frictional force by thrust load, in this synchronizing action, the tape core and rotary drive unit relatively slide on each other smoothly.

The frictional engaging force of the force transmitting means can be set to an optimum value by setting the axial engaging force of the two by properly adjusting the engagement dimensional direction in the axial direction of the rotary drive unit and engaging support member.

These and other objects and features of the invention will be better understood and appreciated from the following detailed description taken in conjunction with the accompanying drawings and the novel facts indicated in the claims.

BRIEF DESCRIPTION OF THE DRAWINGS

FIG. 1(*b*) is a front view showing the inside by removing the cover of the coat film transfer tool.

FIG. 9(*b*) is a perspective view showing a rewind button of the clutch mechanism.

FIG. 13(*b*) is a perspective view showing a rewind button of the clutch mechanism.

FIG. 15(*b*) is a perspective view showing a payout rotary gear of the clutch mechanism.

FIG. 20(*b*) is a sectional view showing the same conventional coat film transfer tool.

FIG. 21(*b*) is a sectional view showing the same conventional coat film transfer tool.

DETAILED DESCRIPTION OF THE PREFERRED EMBODIMENTS

Figure 1:
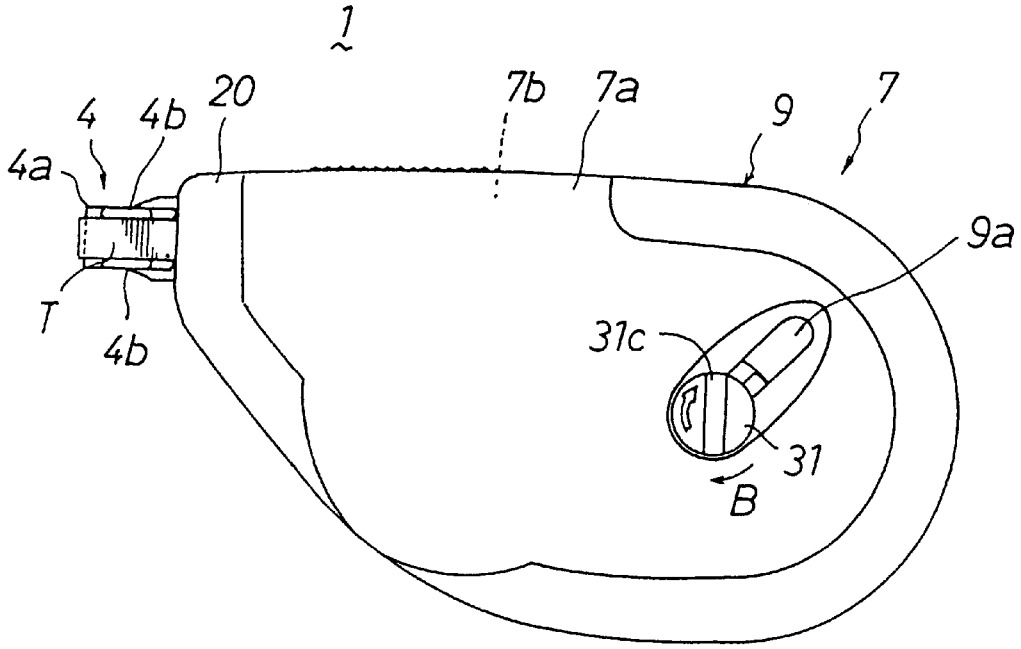
FIG. 1(*a*) is a front view showing a coat film transfer tool in embodiment 1 of the invention.
Figure 1:
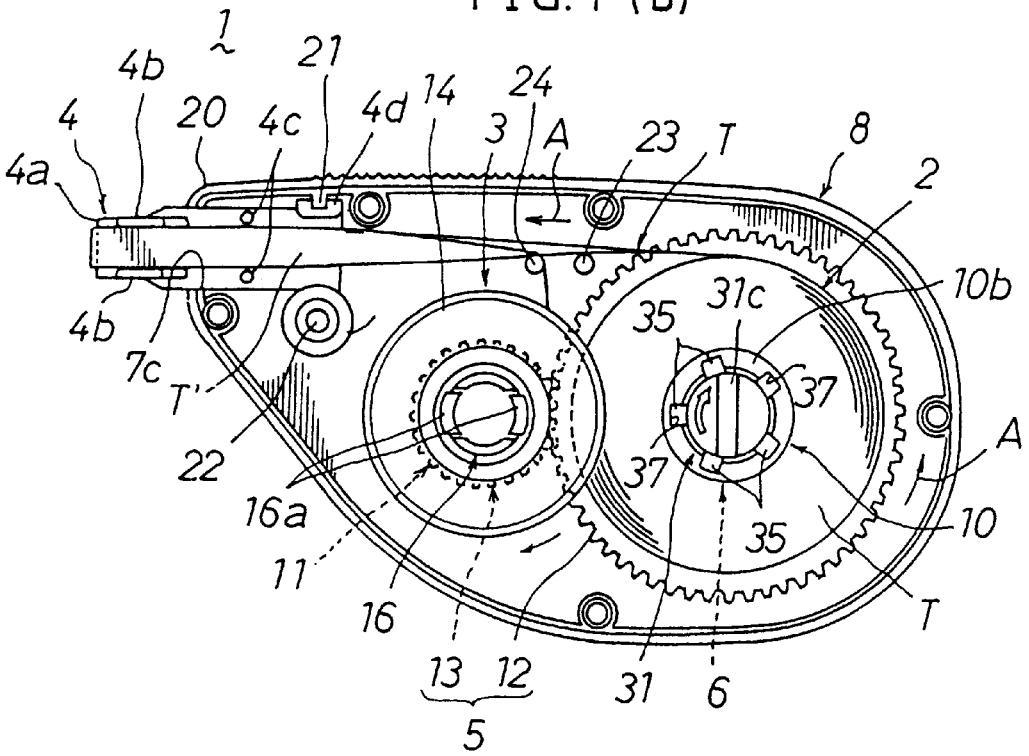

Referring now to the drawings, preferred embodiments of the invention are described in detail below.

Embodiment 1

FIG. 1 through FIG. 8 show a coat film transfer tool of the invention, and same reference numerals throughout the drawings indicate same constituent members or elements.

This coat film transfer tool 1 is specifically a disposable type coat film transfer tool to be used as an eraser for correcting an error, and mainly comprises a payout reel 2, a takeup reel 3, a coat film transfer head 4, a linkage 5, and a clutch mechanism 6, and these constituent members 2 to 6 are incorporated into a case 7 as hand-held manipulating means.

Figure 8:
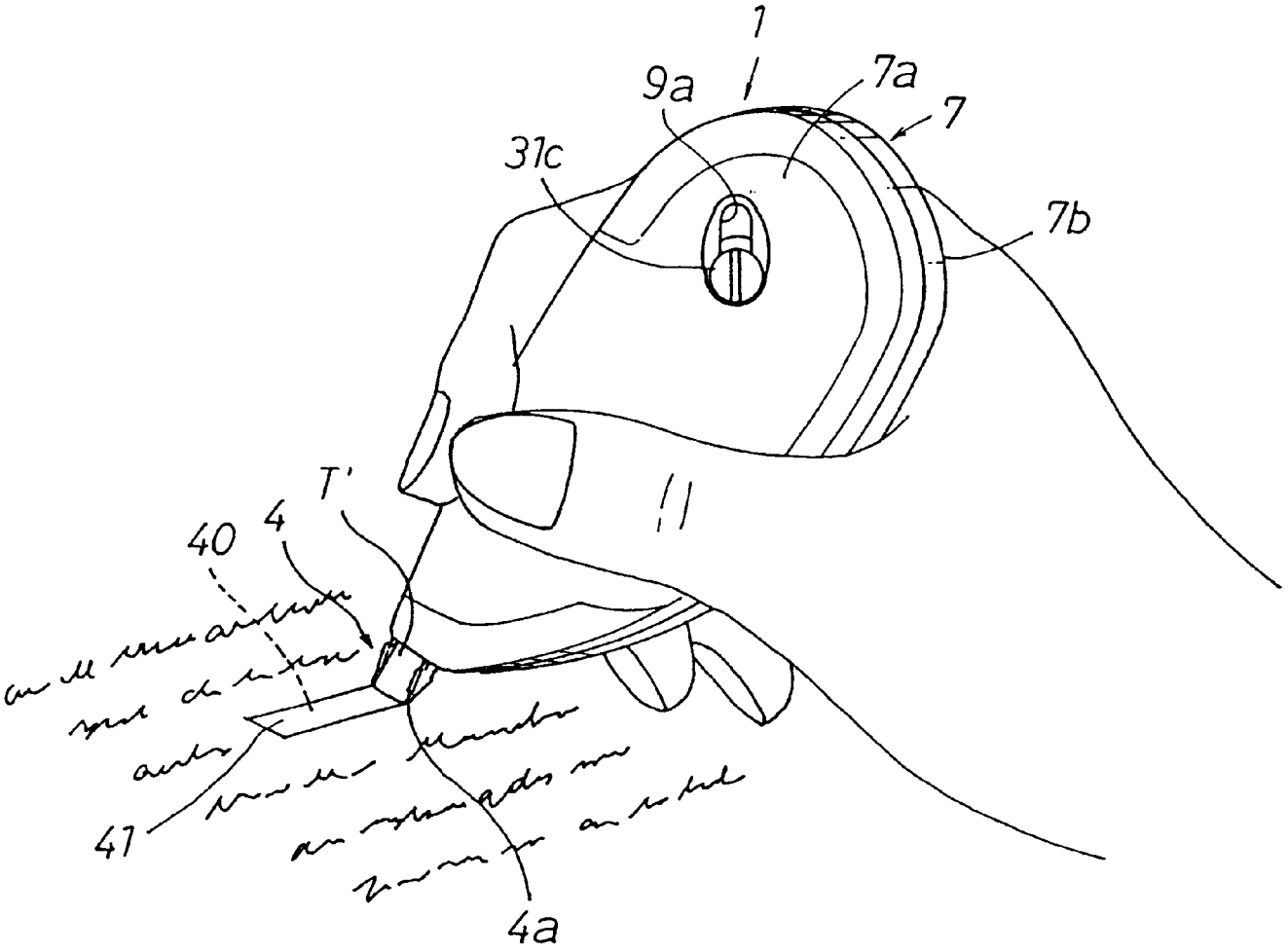
FIG. 8 is a perspective view showing a state of use of the coat film transfer tool.

The case 7 is made of plastic formed by injection molding or the like, and is designed in shape and dimensions to be held and manipulated by one hand. More specifically, the case 7 is formed in a flat box having the front contour shape and width dimensions capable of incorporating the payout reel 2 and takeup reel 3, and is built in a two-division structure consisting of a case main body 8 and a cover 9, and the constituent members 2 to 6 are mounted on the case main body 8. Flat face and back sides 7*a*, 7*b* of the case 7 form gripping surfaces when held and manipulated by hand as shown in FIG. 8. In the cover 8, a penetration hole 9*a* functioning as rewind operation hole and tape inspection hole is opened.

On the payout reel 2, a new coat film transfer tape T is wound on the outer circumference of the hollow cylindrical tape core 10, and this tape core 10 is rotatably supported on a hollow support shaft 15 formed upright integrally on the inner side of the case main body 8 through a payout rotary gear 12 of the linkage 5. The specific mounting structure of this payout reel 2 is described later in relation to the clutch mechanism 6.

The takeup reel 3 is to take up and recover the used coat film transfer tape T', and a leading portion of the coat film transfer tape T is connected to the outer circumference of the hollow cylindrical tape core 11. At one end of the tape core 11, a takeup rotary gear 13 of the linkage 5 is integrally provided, and a tape running guide flange 14 is integrally provided at the other end of the tape core 11, and is rotatably supported on the hollow support shaft 16 formed upright integrally at the inner side of the case main body 8. At the end of the hollow support shaft 16, an arresting portion 16*a* for preventing the tape core 11 from slipping out is provided. At the inner side of the cover 9, a positioning bump 116 is provided corresponding to the hollow support shaft 16, and this positioning bump 116 is inserted into the hollow support shaft 16 when assembling the case 7, thereby supporting the takeup reel 3 from both sides.

The coat film transfer tape T is made of, for example, film base material (thickness about 25 to 38 microns) such as plastic tape made of polyester and acetate or the like, or paper tape, with one side coated with parting agent layer such as vinyl chloride-vinyl acetate copolymer resin layer or low molecular polyethylene layer or the like, and thereon, a white corrective paint layer is formed, and further thereon, adhesive (pressure-sensitive adhesive) layer having pressure-sensitive adhesion such as polyurethane is applied (specific structure is omitted in the drawing). The corrective paint layer is of dry type so as to be capable of writing thereon immediately after transfer.

The coat film transfer head 4 is to press the coat film transfer tape T onto the correction area (transfer area) of error or the like on the sheet of paper, and is provided at the end 20 of the case 7. This head 4 is made of plastic having a certain elasticity.

The leading end portion of the head 4 is a thin plate slightly wider than the coat film transfer tape T as shown in FIG. 1, and has a taper section so as to be gradually thin toward the leading end, and the leading end 4*a* is a pressing portion for pressing the coat film transfer tape T. At both side edges of the leading end portion of this head 4, guide flanges 4*b*, 4*b* for guiding the running of the coat film transfer tape T are formed integrally, and at both sides of the central portion of the rear side, guide pins 4*c*, 4*c* are formed upright integrally corresponding thereto.

At both sides of the leading end portion of the head 4, an engaging recess 4*d* and an engaging tubular portion 4*e* are individually provided, and they are engaged and supported respectively with an engaging bump 21 and an engaging pin 22 of the case main body 8, and the head 4 is positioned and fixed in the case main body 8. Accordingly, the leading end portion of the head 4 projects outward through a leading end opening 7*c* of the case 7, and both flat head sides continuously to the leading end pressing portion 4*a* form tape running surfaces nearly parallel to gripping surfaces 7*a*, 7*b* of the case 7.

Corresponding to such configuration of the head 4, guide pins 23, 24 are formed upright and integrally parallel to the inner side of the case main body 8 between the both reels 2, 3. One guide pin 23 is to guide the coat film transfer tape T paid off from the payout reel 2, and the other guide pin 24 is to guide the coat film transfer tape T' taken up on the takeup reel 3.

Although not shown, a rotatable flanged roll may be also provided in the guide pin 24, and in such construction, neat and smooth takeup action of the coat film transfer tape T' on the tape core 11 of the takeup reel 3 can be assured more securely.

The coat film transfer tape T thus paid out from the payout reel 2 is, as shown in FIG. 1(*b*), guided through the guide pin 23, and is inverted through the pressing section 4*a* of the head 4, and is further guided through the guide pin 24, and is wound on the takeup reel 3. In this case, the pressing section 4*a* of the head 4 cooperates with the tape running surface of the head surface, guides the coat film transfer tape T by setting it nearly opposite to the gripping surfaces 7*a*, 7*b* of the case 7, that is, guides the coat film transfer tape T so that the face and back sides of the coat film transfer tape T may be directed nearly same as (parallel to) the gripping surfaces 7*a*, 7*b*.

The linkage 5 is to link the both reels 2, 3 so as to operate or interlock mutually, and comprises a payout rotary drive section 12 for paying out and rotating the payout reel 2 and a takeup rotary drive section 13 for taking up and rotating the takeup reel 3.

Figure 2:
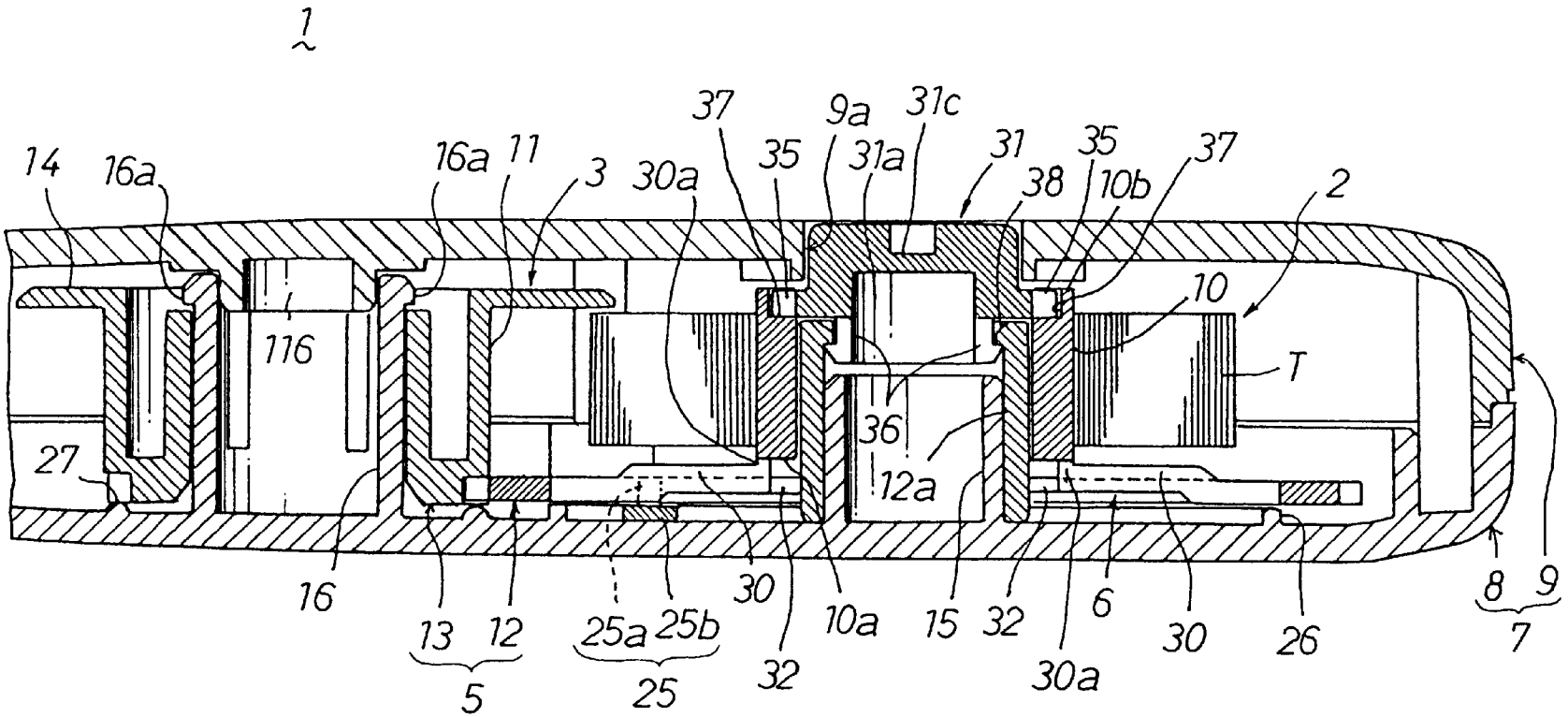
FIG. 2 is a sectional view along line II—II in FIG. 1(*b*) showing the coat film transfer tool.
Figure 3:
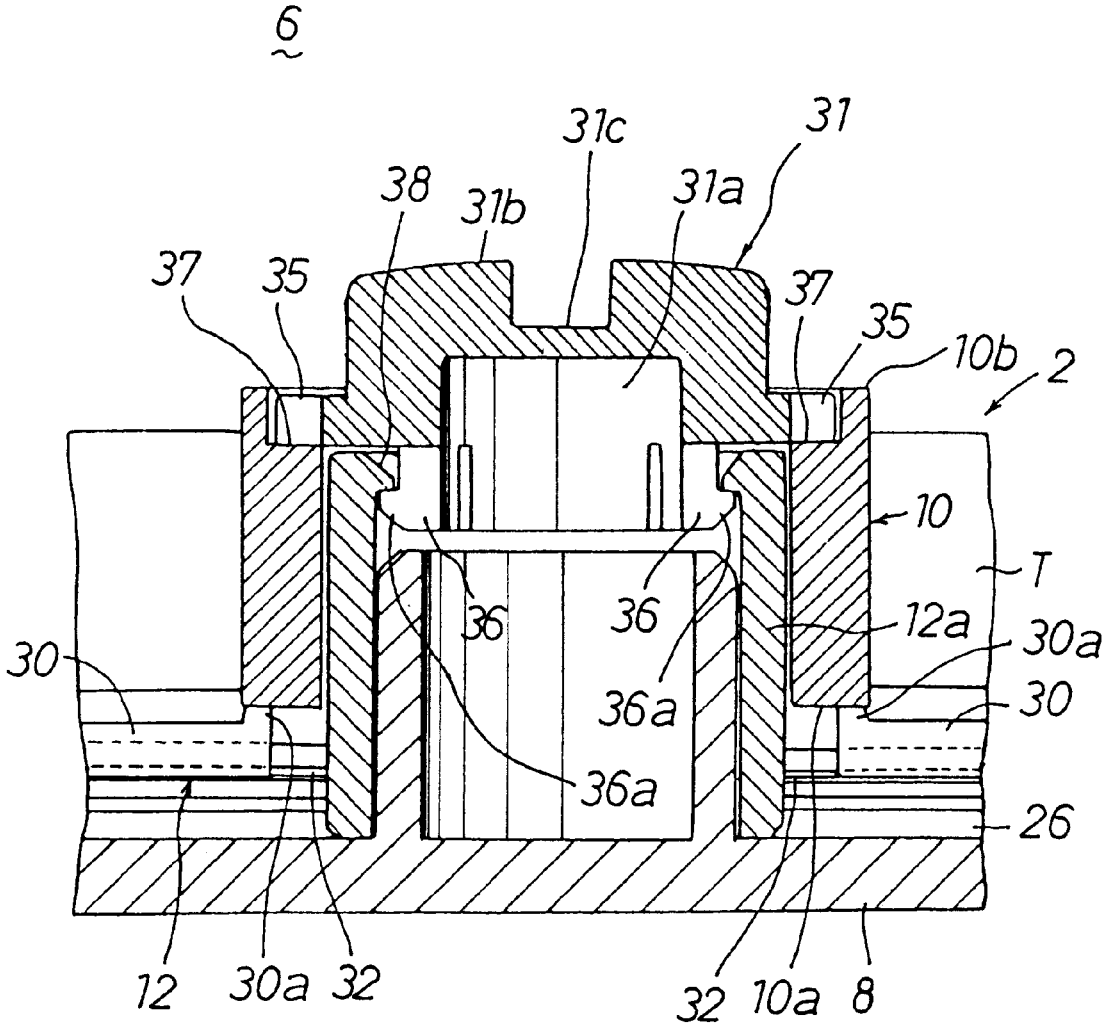
FIG. 3 is a magnified sectional view of a clutch mechanism which is an essential unit of the coat film transfer tool.

The payout rotary drive section 12 is in a form of rotary gear as mentioned above, and its rotary shaft 12*a* is rotatably supported on the hollow support shaft 15 of the case main body 8, and a payout rotary gear 12 is rotatably provided on the case main body 8. In this case, the axial lower end of the rotary shaft 12*a* is supported slidably on the inner side of the case main body 8 as shown in FIG. 2 and FIG. 3. Reference numeral 26 denotes an annular rib provided inside of the inner side of the case main body 8, and this annular rib 26 is disposed concentrically with the hollow support shaft 15 and corresponding to the outer circumference of the payout rotary gear 12, and prevents excessive distortion of the payout rotary gear 12.

On the outer circumference of the rotary shaft 12*a*, the tape core 10 of the payout reel 2 is rotatably supported concentrically, and this tape core 10 and the payout rotary gear 12 are frictionally engaged with each other through engaging protrusions 30, 30, . . . , as frictional engaging members of the clutch mechanism 6 described later.

The takeup rotary drive section 13 is in a form of rotary gear to be engaged with the payout rotary gear 12. The takeup rotary gear 13 is formed coaxially and integrally at one end of the tape core 11 of the takeup reel 3, and is rotatably supported on the hollow support shaft 16 of the case main body 8. At the inner side of the case main body 8, an annular rib 27 is provided concentrically with the hollow support shaft 16 and corresponding to the takeup rotary gear 13, and the takeup rotary gear 13 and the tape core 11 of the takeup reel 3 integral therewith are supported slidably and rotatably on the annular rib 27.

The rotary gear 13 is engaged with the payout rotary gear 12 at a specified gear ratio, and therefore the takeup rotary gear 13 is always rotated in cooperation with the payout rotary gear 12 at a specific ratio of rotation. This ratio of rotation, that is, the gear ratio of the both gears 12, 13 is set properly so that the coat film transfer tape T may be paid out and taken up smoothly, in consideration of the winding diameter of the coat film transfer tape T on the payout reel 2 and takeup reel 3 mentioned later.

In relation thereto, moreover, a reverse rotation preventive mechanism 25 for preventing reverse rotation of the both reels 2, 3 is provided in the payout rotary gear 12 and case main body 8. This reverse rotation preventive mechanism 25 is composed of a pair of elastic detent pawls 25*a*, 25*a* provided deformably on the payout rotary gear 12, and multiple reverse rotation preventive pawls 25*b*, 25*b*, . . . , disposed annularly and concentrically with the hollow support shaft 15 at the inner side of the case main body 8. In the drawing, the position near the leading end of the detent pawl 25*a* is connected and supported to the main body portion of the payout rotary gear 12 by a thin wall connection piece 28 for reinforcement.

Accordingly, when the both reels 2, 3 rotate in the arrow direction, the detent pawls 25*a* ride over the reverse rotation preventive pawls 25*b*, 25*b*, . . . , while deforming elastically, and permit normal rotation. On the other hand, when the both reels 2, 3 rotate in opposite direction to the arrow direction, the detent pawls 25*a* are engaged with any one of the reverse rotation preventive pawls 25*b*, 25*b*, . . . , and block reverse rotation. The reverse rotation preventive mechanism 25 may be provided at the takeup reel 3 side.

The clutch mechanism 6 is designed to synchronize the payout speed and takeup speed of the coat film transfer tape T on the payout reel 2 and takeup reel 3, and in this embodiment it is provided at the payout reel 2 side, and composes power transmitting means between the payout rotary gear 12 and tape core 10.

Figure 4:
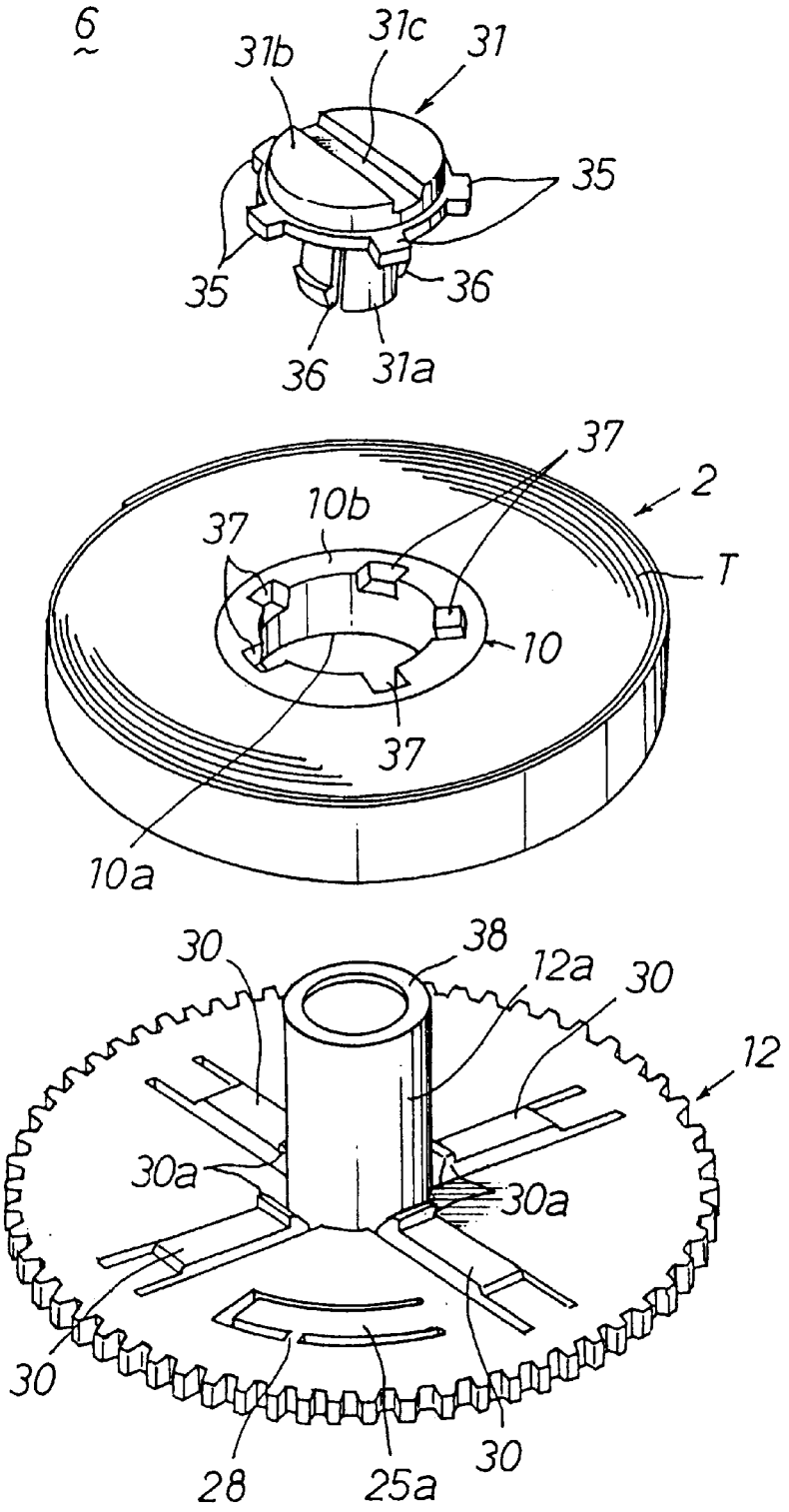
FIG. 4 is a perspective exploded view of the clutch mechanism.
Figure 5:
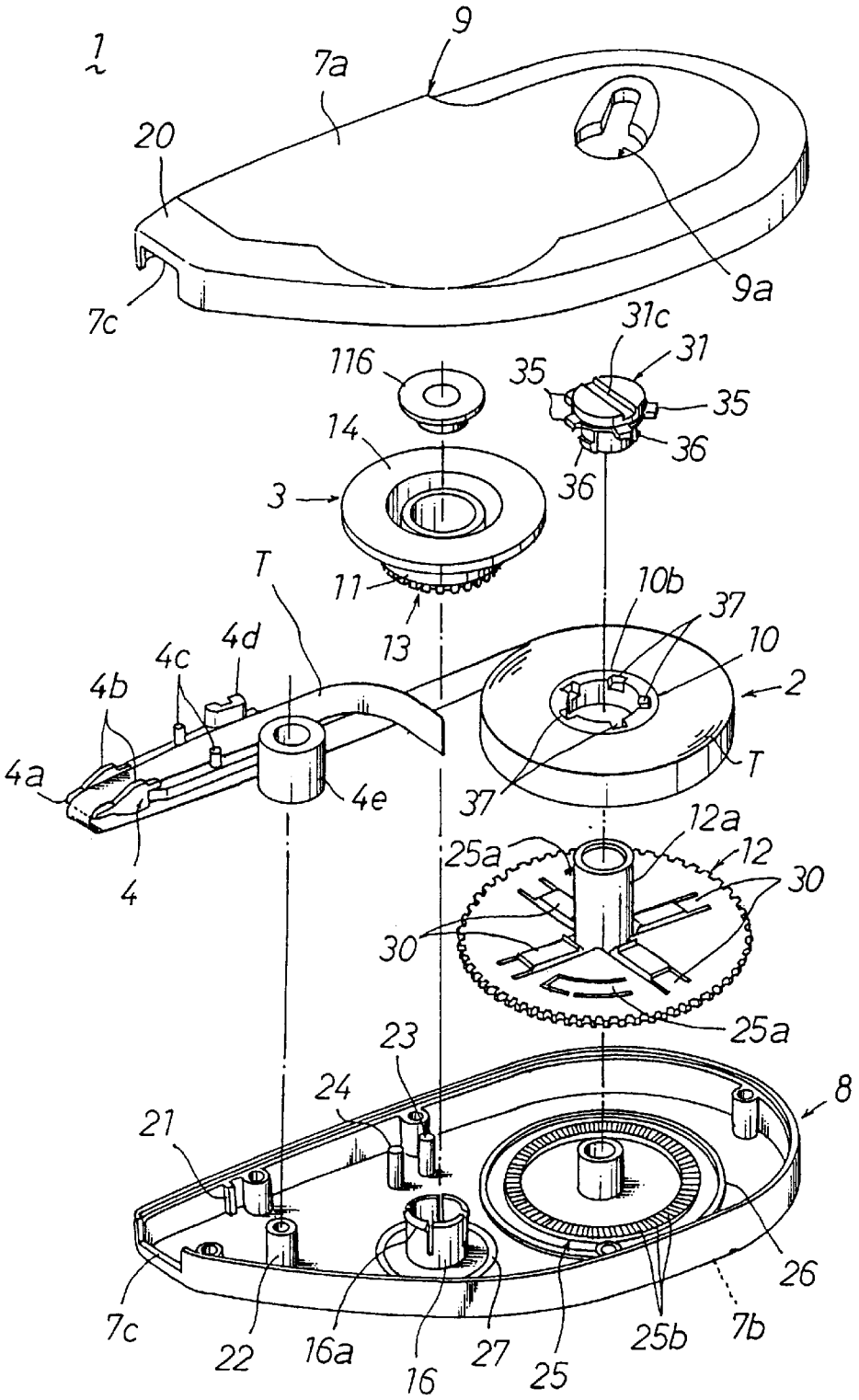
FIG. 5 is a perspective exploded view of the coat film transfer tool.

A specific construction of the clutch mechanism 6 is shown in FIG. 3 through FIG. 5, and mainly comprises plural engaging protrusions 30, 30, . . . , integrally formed in the payout rotary gear 12, and an engaging support member 31.

The engaging protrusions 30 function as frictional engaging members as constituent members of the power transmitting means, and are extended in radial direction and formed integrally in plural positions (four positions in the drawing) in the circumferential direction of the payout rotary gear 12. The engaging protrusions 30 are elastically deformed in the axial direction about the base of the outer side, and also include engaging portions 30*a* swollen upward at the inner leading end. In the illustrated embodiment, the inner leading end of the engaging protrusion 30 is connected and supported to the rotary shaft 12*a* of the payout rotary gear 12 by a thin wall connection piece 32 for reinforcement.

The engaging portion 30*a* of the engaging protrusion 30 is provided so as to project upward from the upper side of the payout rotary gear 12 in stationary state, at the position confronting the axial end 10*a* of the tape core 10, and has an engaging flat plane corresponding to the flat plane of the axial end 10*a*.

The engaging support member 31 is specifically in a form of a rewind button, and functions also as a constituent member for a tape rewind mechanism for eliminating and removing sag of coat film transfer tape T between the both reels 2, 3.

This rewind button 31 includes an axial engaging portion 35 to be engaged with the axial end 10*b* of the tape core 10, and a detent pawl 36 to be engaged with the rotary shaft 12*a* of the payout rotary gear 12.

The axial engaging portion 35 is in a form of an engaging bump projecting horizontally in the radial direction from the outer circumference of the rewind button 31, and functions as the rotary engaging portion of the tape rewind mechanism, and in the illustrated embodiment, five portions 35, 35, . . . are provided at equal intervals in the circumferential direction. By contrast, at the axial end 10*b* of the tape core 10, five engaging recesses 37 to be engaged with the axial engaging portions 35 are provided at equal intervals in the circumferential direction.

The detent pawl 36 is split longitudinally in a form of a slit in part of a mounting cylindrical portion 31*a* of the rewind button 31, and its leading end engaging portion 36*a* is elastically deformable in the radial direction. In the illustrated embodiment, a pair of detent pawls 36, 36 are disposed oppositely on a diameter line of the mounting cylindrical portion 31*a*, and the engaging leading end 36*a* of the detent pawl 36 is formed in a downward wedge shape.

In correspondence thereto, in the inner circumference of the rotary shaft 12*a* of the payout rotary gear 12, an engaging flange 38 to be engaged with the detent pawl 36 in the axial direction is provided. The inside diameter of the engaging flange 38 is set in a proper size so that the mounting cylindrical portion 31*a* of the rewind button 31 may be inserted, and that the engaging leading end 36*a* of the detent pawl 36 may be engaged so as not to slip out.

Figure 6A:
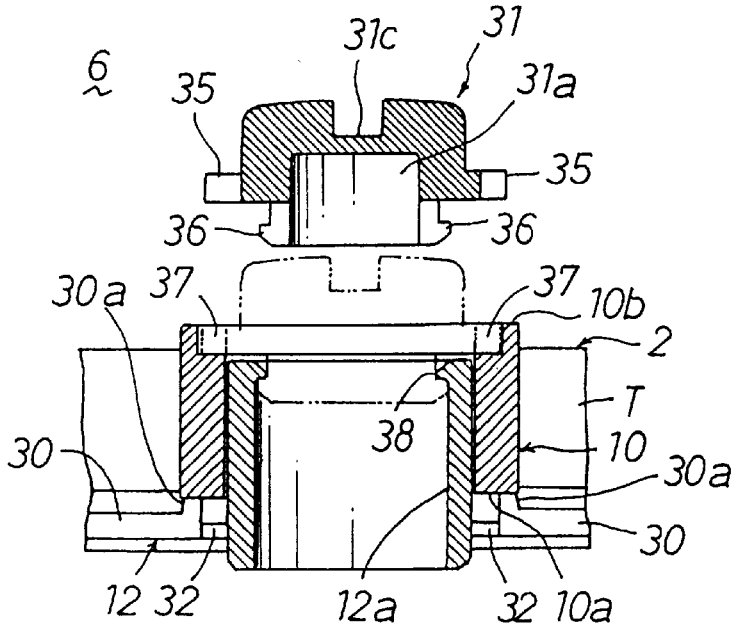
FIGS. 6(*a*) through 6(*c*) are explanatory assembly views of the clutch mechanism.
Figure 6B:
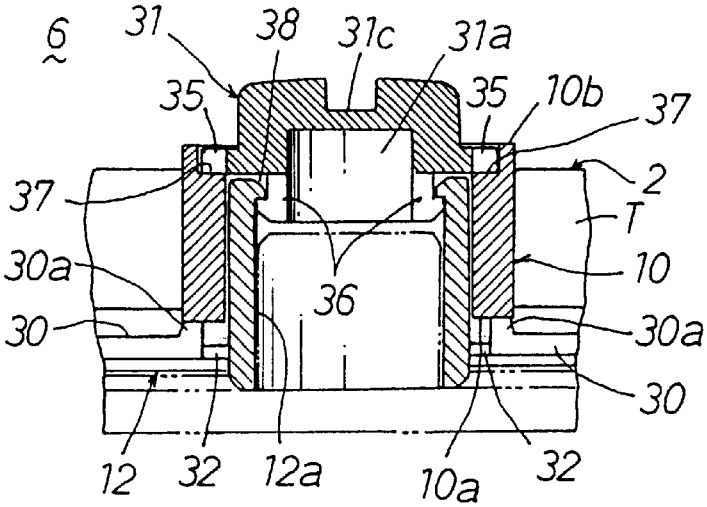
Figure 6C:
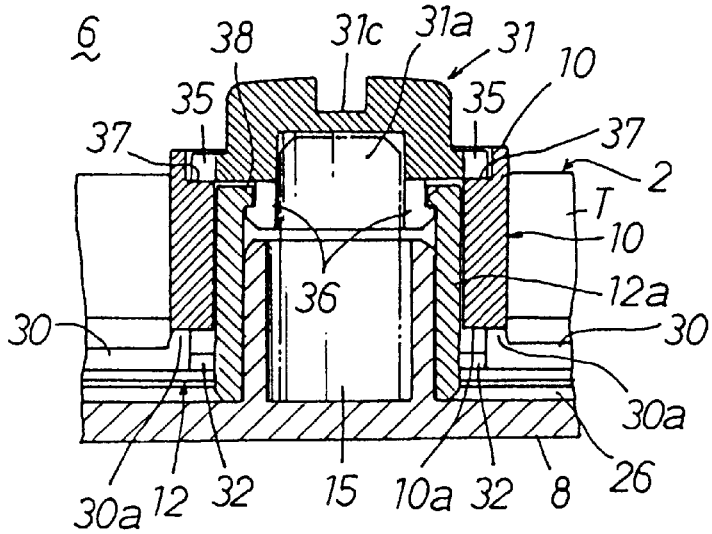

Therefore, after inserting the tape core 10 of the payout reel 2 into the rotary shaft 12*a* of the payout rotary gear 12 (see FIG. 6(*a*)), the rewind button 31 is inserted into the rotary shaft 12*a* of the payout rotary gear 12 so that its axial engaging portions 35, 35, . . . may correspond to the engaging recesses 37, 37, . . . of the tape core 10. As a result, the detent pawls 36,36 of the rewind button 31 are elastically deformed to the radial inner side and pass in the axial direction, against the engaging flange 38 of the rotary shaft 12*a*, and then return elastically to be engaged with the engaging flange 38 so as not to slip out.

Consequently, the tape core 10 is held and supported from both sides in the axial direction by the engaging protrusions 30, 30, . . . of the payout rotary gear 12 and axial engaging portions 35, 35, . . . of the rewind button 31, and at the same time, by the axial engaging force of the payout rotary gear 12 and rewind button 31, the engaging protrusions 30, 30, . . . of the payout rotary gear 12 are elastically engaged frictionally in the rotating direction with a specific pressing force at the axial end 10*a* of the tape core 10.

That is, as the power transmission of the clutch mechanism 6, the frictional engaging force by thrust load acting between the axial end 10*a* of the tape core 10 and the engaging protrusions 30, 30, . . . of the payout rotary gear 12 is utilized, and this frictional engaging force is set at an optimum value by properly adjusting the engaging dimensional relation of the payout rotary gear 12 and rewind button 31 in the axial direction.

More specifically, in consideration of the spring constant and elastic deformation amount of the engaging protrusions 30, 30, . . . of the payout rotary gear 12, the relative axial positional relation of the tape core 10 and payout rotary gear 12 by the axial engaging portions 35 and detent pawls 36 of the rewind button 31 is properly adjusted, and the frictional engaging force of the engaging protrusions 30, 30, . . . and the axial end 10*a* of the tape core 10 is set at an optimum value.

Figure 7A:
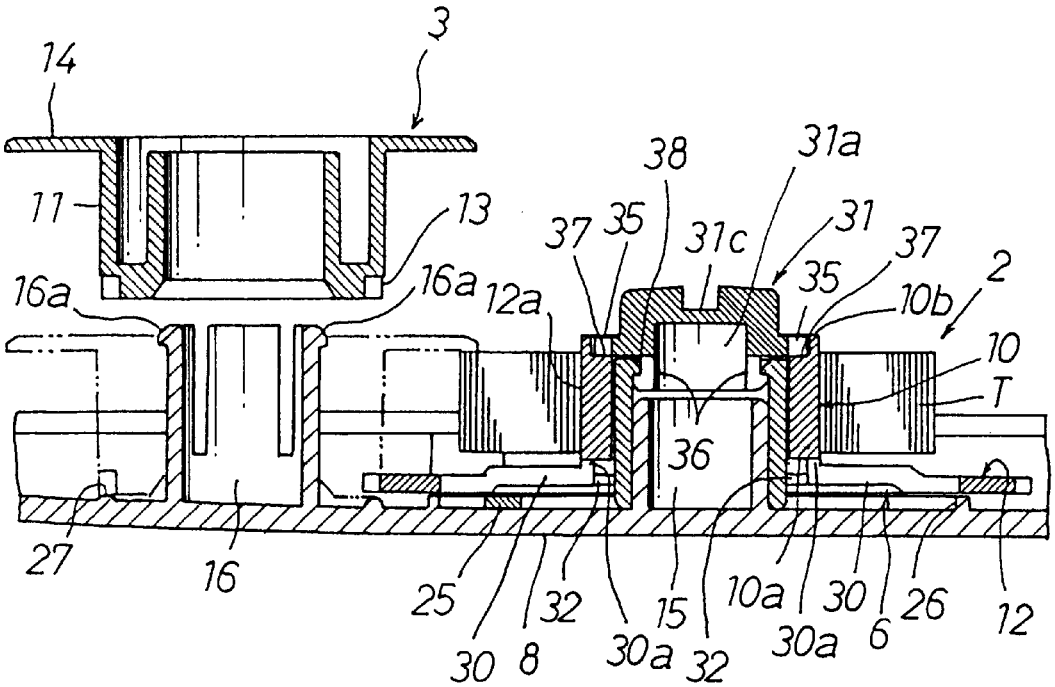
FIGS. 7(*a*) and 7(*b*) are explanatory assembly views of the coat film transfer tool.
Figure 7B:
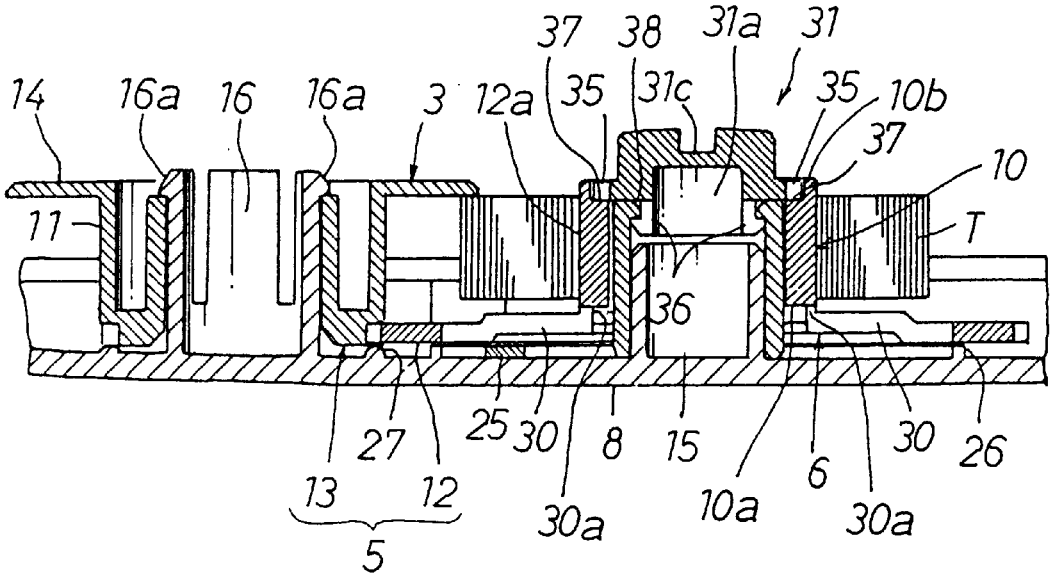

In assembling of the coat film transfer tool 1, in the first place, thus assembled unit of payout reel 2, payout rotary gear 12 and rewind button 31 is mounted and supported on the hollow support shaft 15 of the case main body 8 as shown in FIG. 6(*c*) and FIG. 7(*a*) (in this state, the members 2, 12, 31 can be dismounted from the case main body 8). In succession, the takeup reel 3 is mounted and supported on the hollow support shaft 16 of the case main body 8, so that the takeup reel 3 is prevented from slipping out of the hollow support shaft 16 by the locking portion 16*a* of the hollow support shaft 16, and by the engaging action of the takeup reel 3 with the payout rotary gear 12 of the tape core 11, the members 2, 12, 31 are not dismounted from the case main body 8, so that the ease of subsequent assembling work is assured.

The rewind button 31 is confronting to the outside of the case 7 through a penetration hole 9*a* formed in the cover 9 of the case 7 as shown in FIG. 1(*a*) and FIG. 2. The rewind button 31 is set so as to be nearly flush with or lower than the surface of the case 7, that is, the gripping surface 7*b* (see FIG. 2). At the outer end or outer side 31*b* of the rewind button 31, a linear manipulation groove 31*c* is formed as a rotary manipulation portion for rewind rotary manipulation, and a plate manipulating member such as a coin is detachably engaged with this manipulating groove 31*c*.

By thus constructed coat film transfer tool 1, when correcting part of letters written laterally such as alphabet, as shown in FIG. 8, the gripping surfaces 7*a*, 7*b* of the case 7 are held by fingers as if holding a writing implement. In this gripping position, the pressing portion 4*a* of the head 4 is pressed against the start end (left side) of the correction area (transfer area) 40 on the sheet of paper for correcting an error, and the case 7 is directly moved in the lateral direction, that is, in the rightward direction on the sheet of paper, and is stopped at the terminal end (right end) of the correction area 40.

By this manipulation, the corrective paint layer (white) 41 of the coat film transfer tape T in the pressing portion 4*a* of the head 4 is peeled from the film base material, and is transferred and applied on the correction area 40. As a result, the error is covered and erased, and a correct letter can be written over immediately.

Looking into the internal mechanism and operation of the coat film transfer tool 1, by such pressing manipulation of the coat film transfer head 4, when a tensile force (arrow A direction in FIG. 1(*b*)) applied on the coat film transfer tape T acts on the payout reel 2 as rotary torque, the payout rotary gear 12 rotates through the tape core 10 of the payout reel 2 and further the clutch mechanism 6. This rotating force causes to rotate, through the linkage 5, the takeup rotary gear 13 and also takeup reel 3 in cooperation, so that the used coat film transfer tape T' is taken up automatically.

In this case, the ratio of rotation of the payout rotary gear 12 and takeup rotary gear 13 (corresponding to the gear ratio of the linkage 5) is always constant, while the ratio of the outside diameter of the coat film transfer tape T on the payout reel 2 to the outside diameter of the coat film transfer tape T' on the takeup reel 3 changes in the course of time and is not constant. That is, as used repeatedly, the outside diameter of the coat film transfer tape T on the payout reel 2 gradually decreases, while the outside diameter of the coat film transfer tape T' on the takeup reel 3 increases to the contrary.

Accordingly, the takeup speed of the takeup reel 3 becomes gradually faster than the payout speed of the payout reel 2, and the synchronism of two speeds is broken, and the rotary torque acting on the payout reel 2 gradually increases. In the meantime, the rotary torque overcomes the frictional force of the clutch mechanism 6, and the tape core 10 slips and rotates against the payout rotary gear 12, and the rotary torque difference between the both reels 2, 3 is canceled, and the payout speed is synchronized with the takeup speed, so that smooth running of the coat film transfer tape T is assured.

As mentioned above, since power transmission in the clutch mechanism 6 makes use of the frictional force by thrust load between the tape core 10 and engaging protrusions 30, 30, . . . of the payout rotary gear 12, the construction of the clutch mechanism 6 can set the frictional force at an optimum value by properly adjusting the relative dimension in the thrust direction among the members 2, 12, 31.

Due to mishandling of the use or the like, if the coat film transfer tape T becomes loose between the payout reel 2 and takeup reel 3, the rewind button 31 is rotated in the rewind direction (in arrow B direction in FIG. 1) from the outside of the case 7, and looseness of the coat film transfer tape T is eliminated.

In this case, the rotating force in the rewind direction B applied on the rewind button 31 is directly transmitted to the tape core 10 through the rotary engaging portions 35, 35, . . . serving also as axial engaging portions, and the tape core 10 is rotated in the rewind direction B. On the other hand, due to reverse rotation preventive force by the reverse rotation preventive mechanism 25 and slipping action of the clutch mechanism 6, the rotary gears 12, 13 of the linkage 5 and the tape core 11 of the takeup reel 3 are in stopped state. As a result, the looseness of the coat film transfer tape T between the both reels 2, 3 is eliminated.

Embodiment 2

Figure 9A:
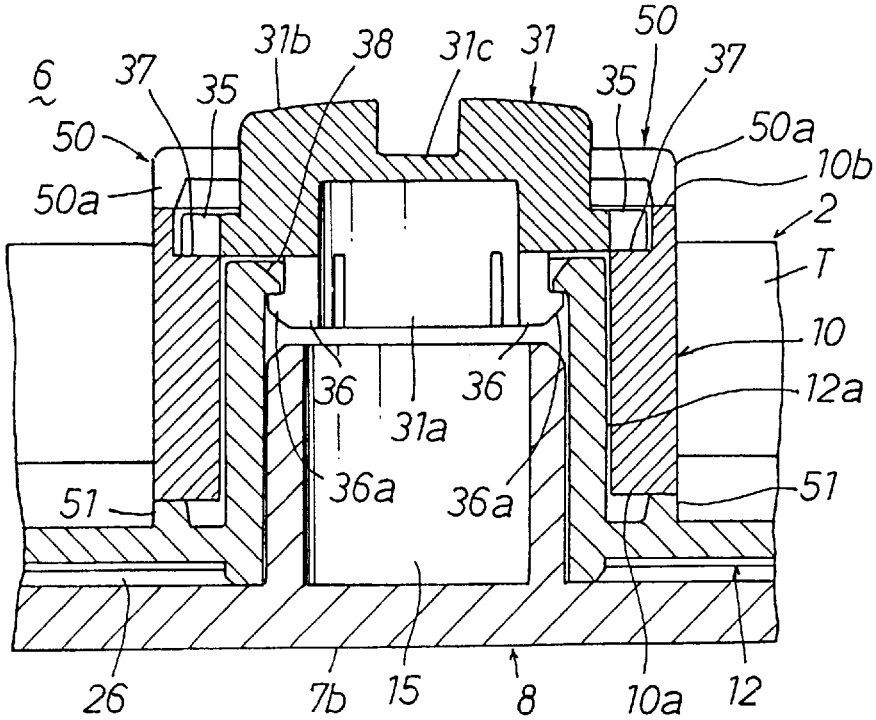
FIG. 9(*a*) is a magnified sectional view corresponding to FIG. 3, showing a clutch mechanism of a coat film transfer tool in embodiment 2 of the invention.
Figure 9B:
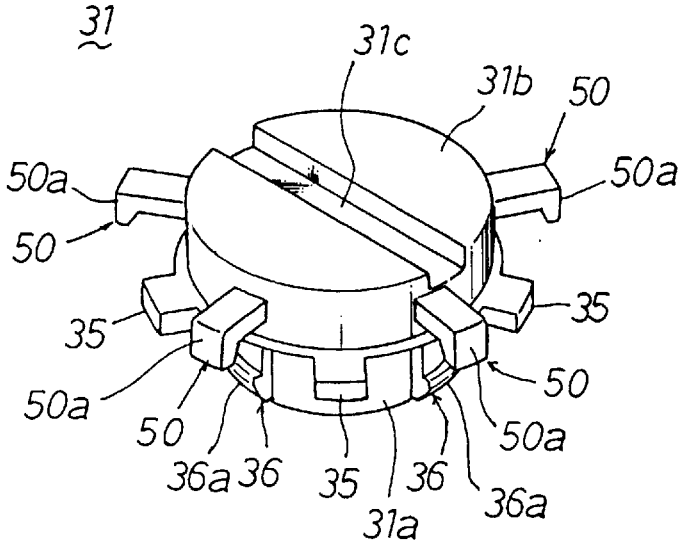

This embodiment is shown in FIG. 9, in which engaging protrusions 50, 50, . . . of the clutch mechanism 6 are provided in the rewind button 31.

That is, the engaging protrusions 50 in the embodiment are extended horizontally in the radial direction and formed integrally at plural positions (five positions in the shown example) in the circumferential direction of the rewind button 31. The engaging protrusions 50 are elastically deformable in the axial direction about the base of the inner circumference, and include engaging portions 50*a* swollen downward at the outer leading end. In the illustrated embodiment, considering ease of molding of the rewind button 31 by injection molding or the like, the engaging protrusions 50 are positioned uniformly between the axial engaging portions 35, 35.

The engaging portions 50*a* of the engaging protrusions 50 are disposed at positions corresponding to the axial end 10*b* of the tape core 10, and include engaging flat planes corresponding to the flat planes of the axial end 10*b*, that is, the outer portions of the engaging recesses 37, 37, . . .

Corresponding to the construction of the engaging protrusions 50, 50, . . . , on the top of the payout rotary gear 12, an engaging rib 51 is provided corresponding to the flat outer circumference of the axial end 10*a* of the tape core 10, so that the axial end 10*a* may be supported in frictional engagement state.

In this way, as the detent pawls 36, 36 of the rewind button 31 are engaged with the engaging flanges 38 of the rotary shaft 12*a* to be prevented from slipping out, the tape core 10 is held and supported from both sides in the axial direction by the engaging rib 51 of the payout rotary gear 12 and engaging protrusions 50, 50, . . . of the rewind button 31.

The engaging protrusions 50, 50, . . . are elastically engaged frictionally in the axial direction with a specified pressing force with the axial end 10*b* of the tape core 10, and the force of the clutch mechanism 6 is transmitted, same as in embodiment 1, by making use of the frictional engaging force by thrust load acting between the axial end 10*b* of the tape core 10 and the engaging protrusions 50, 50, . . . of the rewind button 31.

In this case, the frictional engaging force is set by properly adjusting by engaging dimensional relation in the axial direction between the payout rotary gear 12 and rewind button 31, same as in embodiment 1, and further in this embodiment, the engaging portions 35 of the rewinding button 31 function only as the rotary engaging portions of the tape rewind mechanism, not functioning as axial engaging portions. More specifically, in this embodiment, the engaging protrusions 50, 50, . . . function also as the axial engaging portions. Hence, in the engaged state of the detent pawls 36, 36 and engaging flange 38, the dimensional relation is designed so that the engaging portions 35, 35, . . . are engaged with the engaging recesses 37, 37, . . . of the axial end 10*b* of the tape core 10 only in the rotating direction, and not engaged in the axial direction.

The other construction and action are same as in embodiment 1.

Embodiment 3

Figure 10:
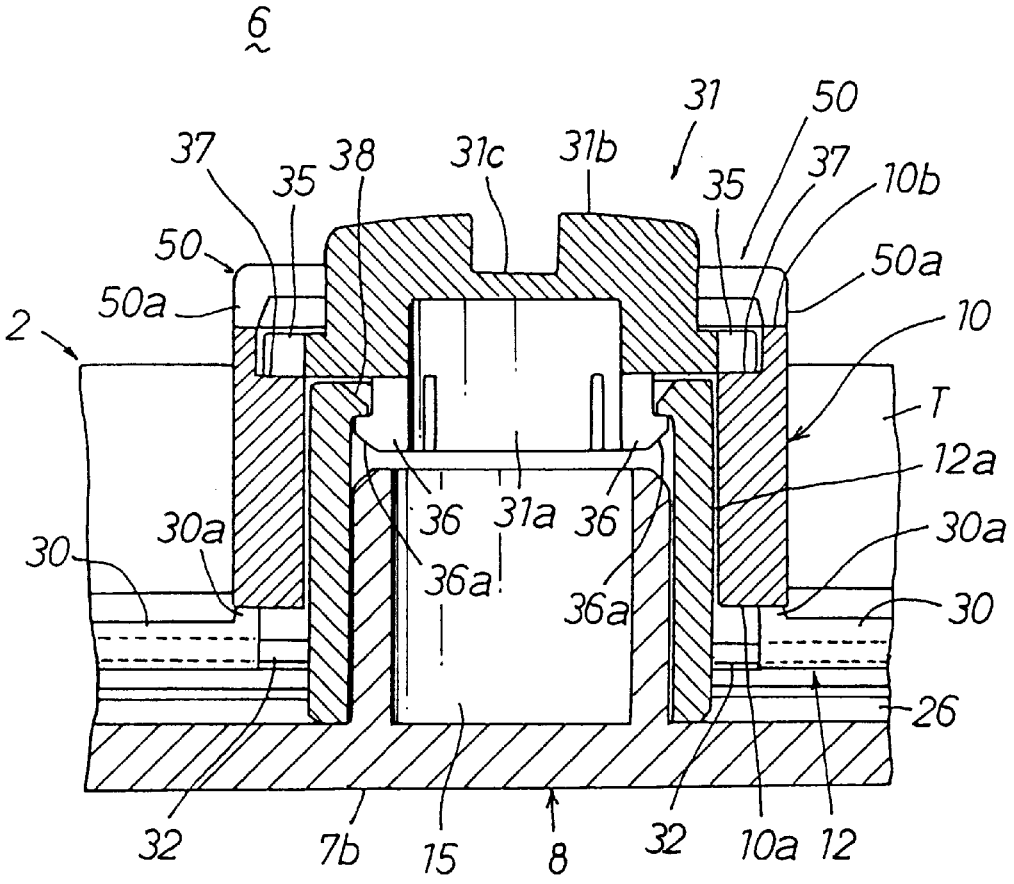
FIG. 10 is a magnified sectional view corresponding to FIG. 3, showing a clutch mechanism of a coat film transfer tool in embodiment 3 of the invention.

This embodiment is shown in FIG. 10, in which the clutch mechanism 6 is a combination of the construction of embodiment 1 (FIG. 1 through FIG. 8) and the construction of embodiment 2 (FIG. 9).

That is, in this embodiment, the engaging protrusions 30, 30, . . . are integrally formed on the payout rotary gear 12, while engaging protrusions 50, 50, . . . are integrally formed on the rewind button 31, and the specific construction of these engaging protrusions 30, 50 is same as in embodiment 1 and embodiment 2, respectively.

Thus, as the detent pawls 36, 36 of the rewind button 31 are engaged with the engaging flanges 38 of the rotary shaft 12*a* to be prevented from slipping out, the tape core 10 is held and supported from both sides in the axial direction by the engaging protrusions 30, 30, . . . of the payout rotary gear 12 and engaging protrusions 50, 50, . . . of the rewind button 31.

The both engaging protrusions 30, 50, . . . are elastically engaged frictionally in the axial direction with a specified pressing force with both the axial ends 10*a*, 10*b* of the tape core 10, and the force of the clutch mechanism 6 is transmitted by making use of the frictional engaging force acting between the both axial ends 10*a*, 10*b* of the tape core 10 and the engaging protrusions 30, 50, . . .

The other construction and action are same as in embodiment 1.

Embodiment 4

Figure 11:
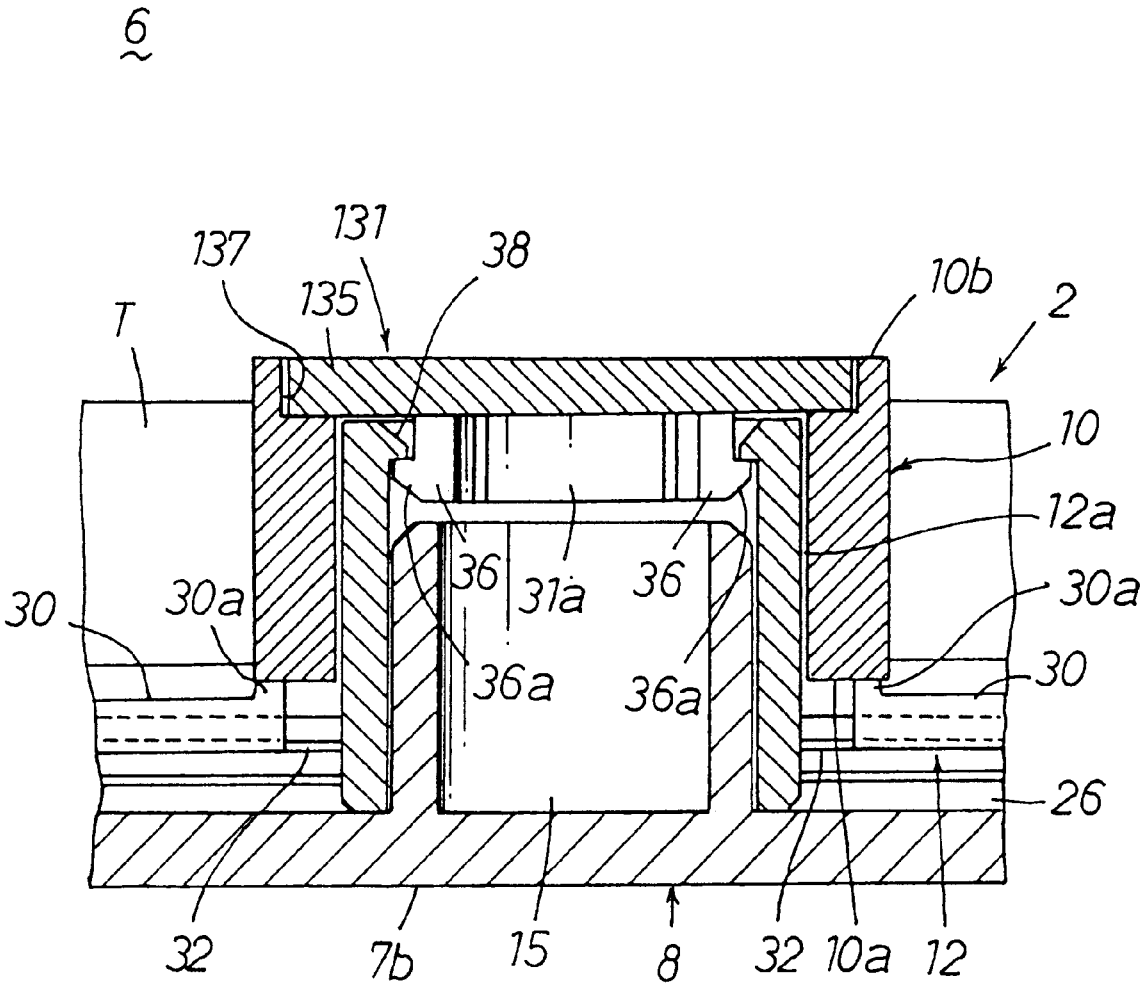
FIG. 11 is a magnified sectional view corresponding to FIG. 3, showing a clutch mechanism of a coat film transfer tool in embodiment 4 of the invention.
Figure 12:
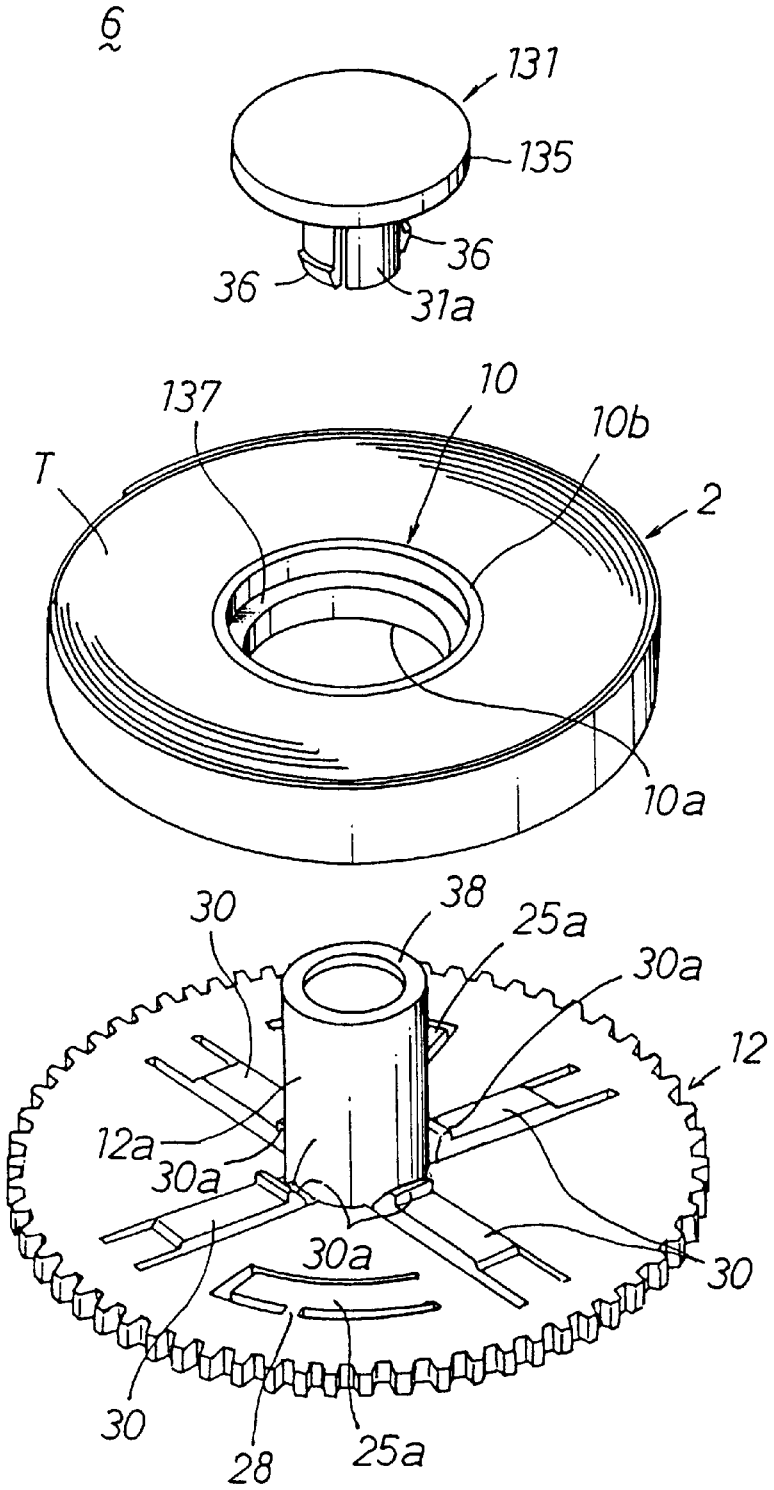
FIG. 12 is a perspective exploded view corresponding to FIG. 4, showing the clutch mechanism.

This embodiment is shown in FIG. 11 and FIG. 12, in which the tape rewind mechanism in embodiment 1 (FIG. 1 through FIG. 8) is omitted.

That is, in the clutch mechanism 6 of the embodiment, an engaging support member 131 is in a shape and size to be put in the case 7, and an axial engaging portion 135 provided in this engaging support member 131 is in a form of an engaging flange projecting horizontally in the axial direction from the outer circumference of the engaging support member 131 as shown in FIG. 12.

By contrast, an engaging recess 137 is formed at the axial end 10*b* of the tape core 10, and this engaging recess 137 is in a form of an annular recess so as to be engaged with the outer circumference of the engaging flange 135.

The other construction and action are same as in embodiment 1.

Embodiment 5

Figure 13A:
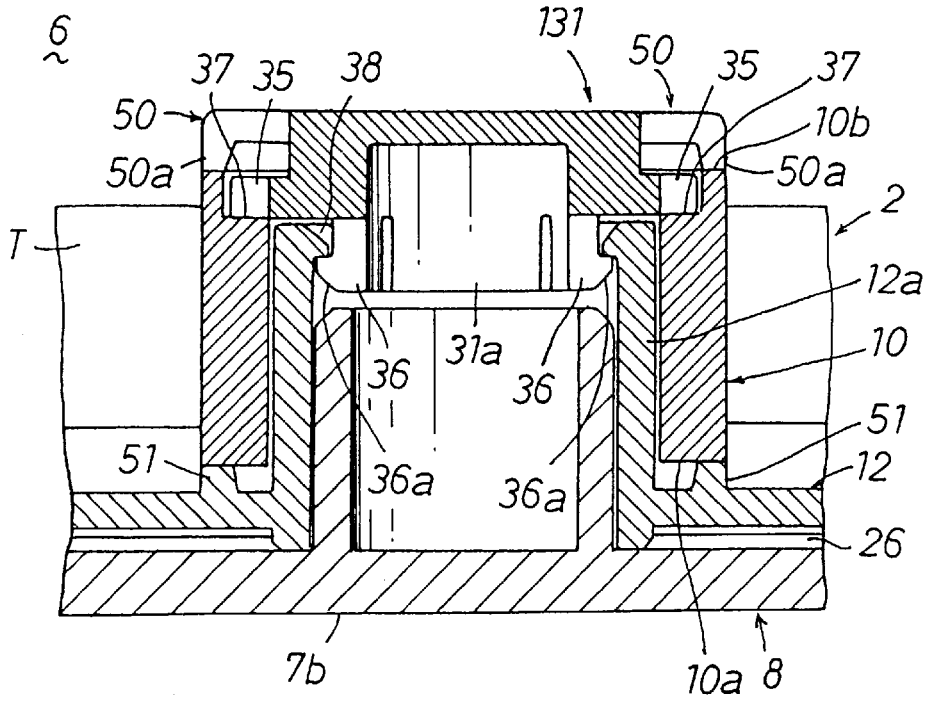
FIG. 13(*a*) is a magnified sectional view corresponding to FIG. 3, showing a clutch mechanism of a coat film transfer tool in embodiment 5 of the invention.
Figure 13B:
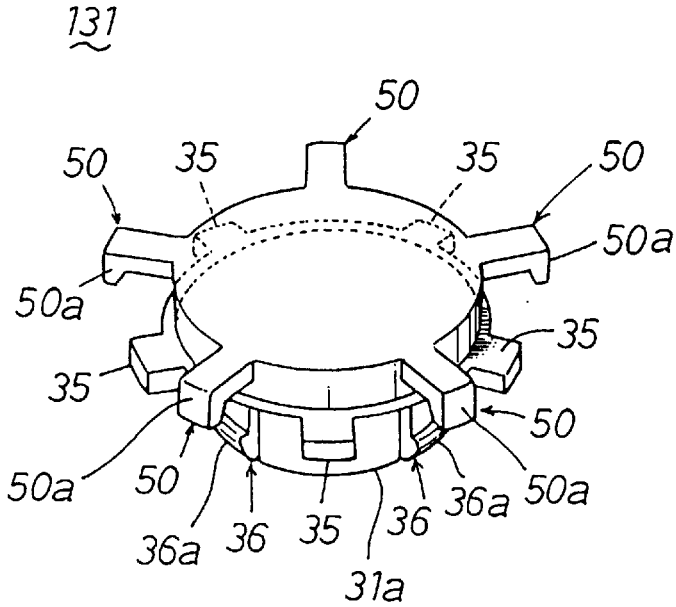

This embodiment is shown in FIG. 13, in which, same as in embodiment 4, the tape rewind mechanism is omitted in the clutch mechanism 6, and a frictional engaging member is disposed integrally with the engaging support member 131.

More specifically, the clutch mechanism 6 of this embodiment is a combination of the construction of embodiment 4 and the construction of embodiment 2. In this case, same as in embodiment 2, considering the ease of molding the engaging support member 131 by injection molding or the like, the engaging protrusions 50 are formed at uniform positions between the axial engaging portions 35, 35.

The other construction and action are same as in embodiment 4.

Embodiment 6

Figure 14:
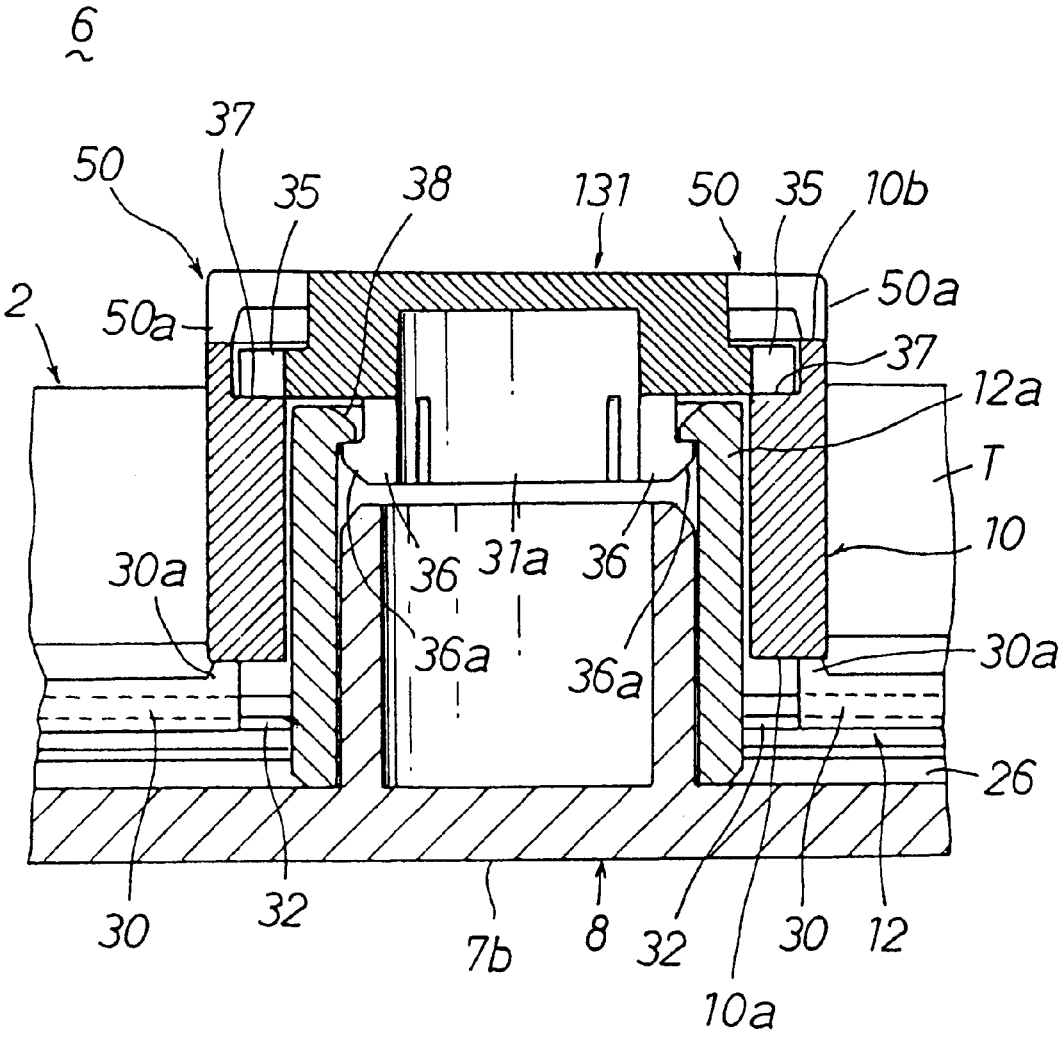
FIG. 14 is a magnified sectional view corresponding to FIG. 3, showing a clutch mechanism of a coat film transfer tool in embodiment 6 of the invention.

This embodiment is shown in FIG. 14, in which the clutch mechanism 6 is a combination of the construction of embodiment 1 (FIG. 1 through FIG. 8) and the construction of embodiment 5 (FIG. 13).

That is, in this embodiment, the engaging protrusions 30, 30, . . . are integrally formed on the payout rotary gear 12, while engaging protrusions 50, 50, . . . are integrally formed on the engaging support member 131, and the specific construction of these engaging protrusions 30, 50 is same as in embodiment 1 and embodiment 5, respectively.

The other construction and action are same as in embodiment 4.

Embodiment 7

Figure 15:
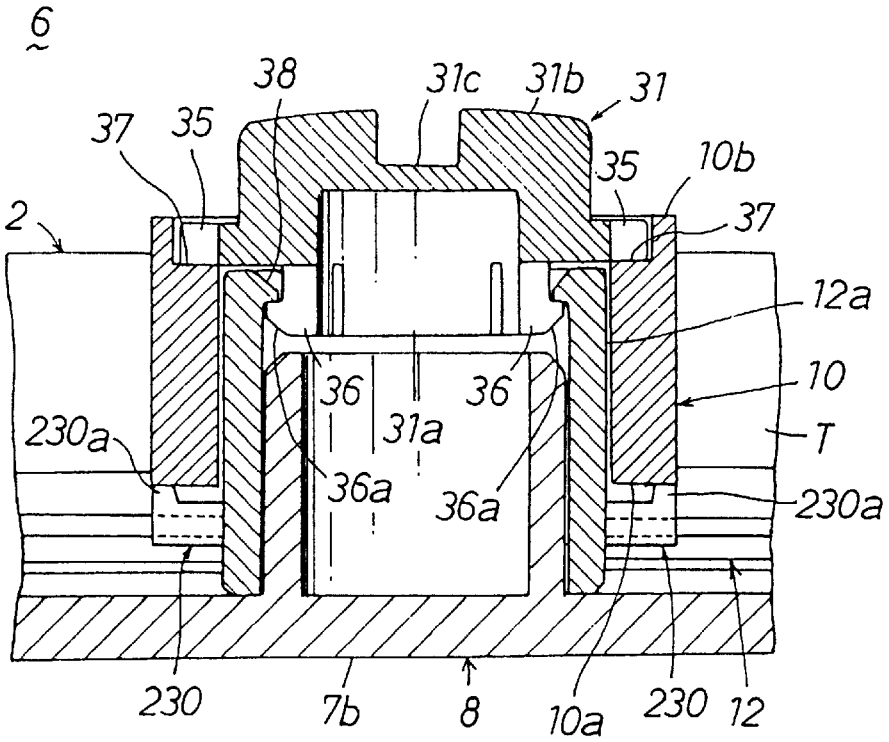
FIG. 15(*a*) is a magnified sectional view corresponding to FIG. 3, showing a clutch mechanism of a coat film transfer tool in embodiment 7 of the invention.
Figure 15:
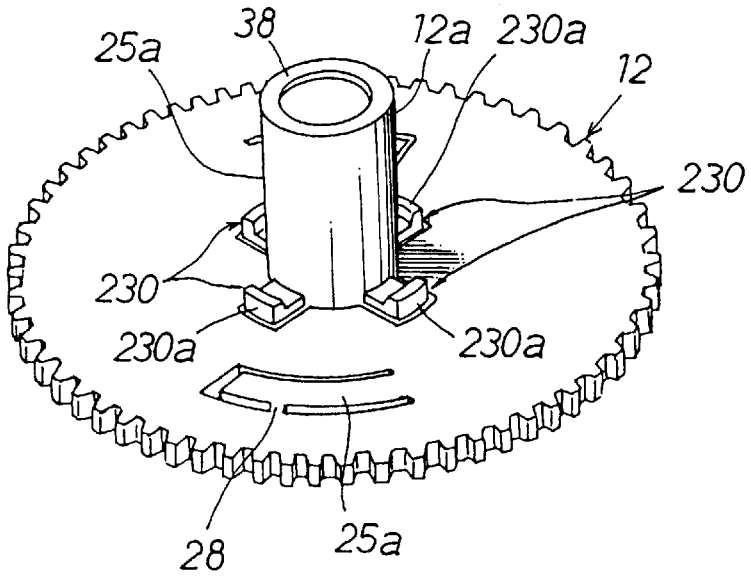

This embodiment is shown in FIG. 15, in which the clutch mechanism 6 in embodiment 1 is slightly modified. That is, engaging protrusions (frictional engaging members) 230, 230, . . . integrally formed on the payout rotary gear 12 are disposed as being extended to the outer side in the radial direction from the rotary shaft 12*a* of the payout rotary gear 12, and their engaging portions 230*a*, 230*a*, . . . are frictionally engaged with the axial end 10*a* of the tape core 10.

The other construction and action are same as in embodiment 1.

Embodiment 8

Figure 16:
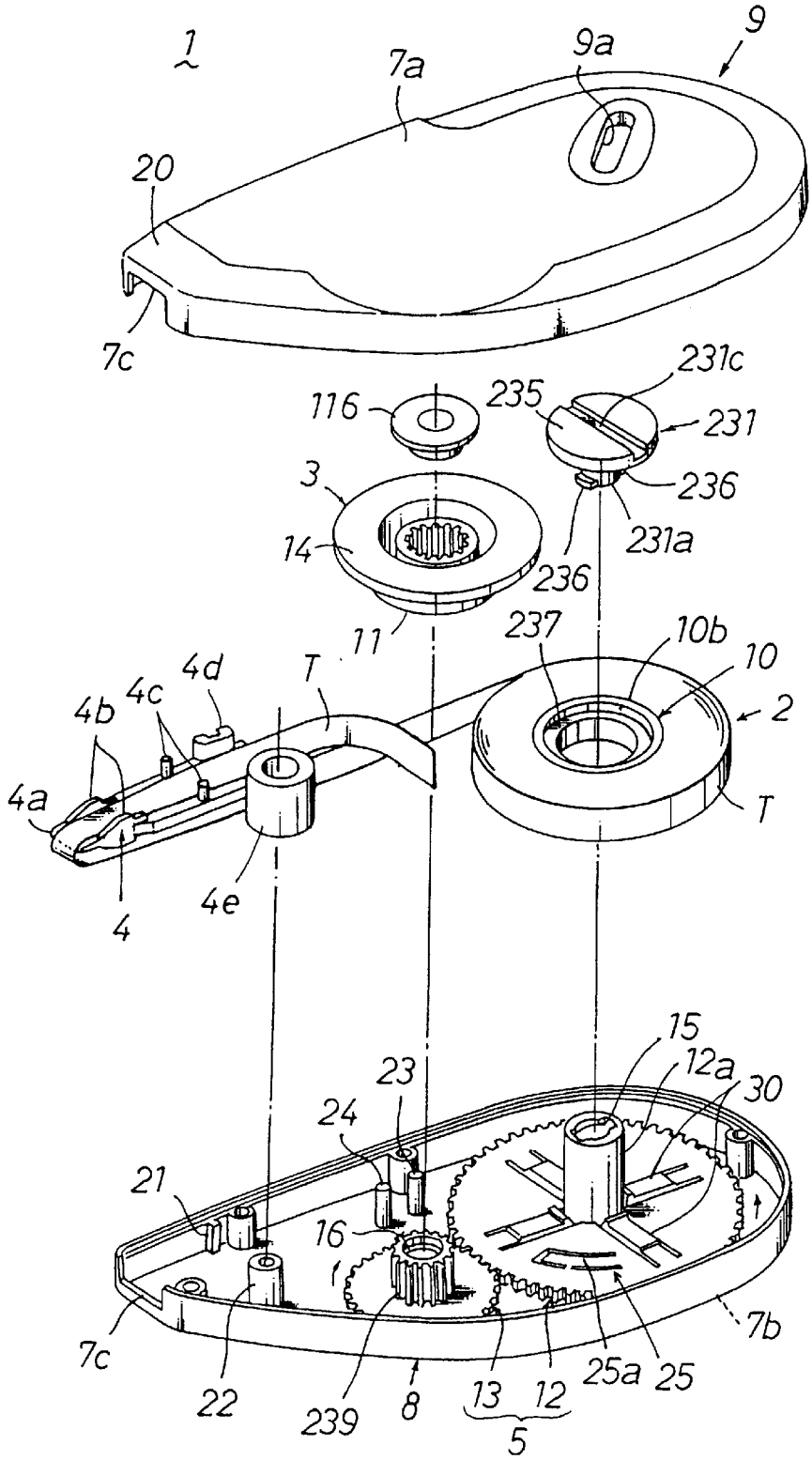
FIG. 16 is a perspective exploded view corresponding to FIG. 5, showing a coat film transfer tool in embodiment 8 of the invention.
Figure 17:
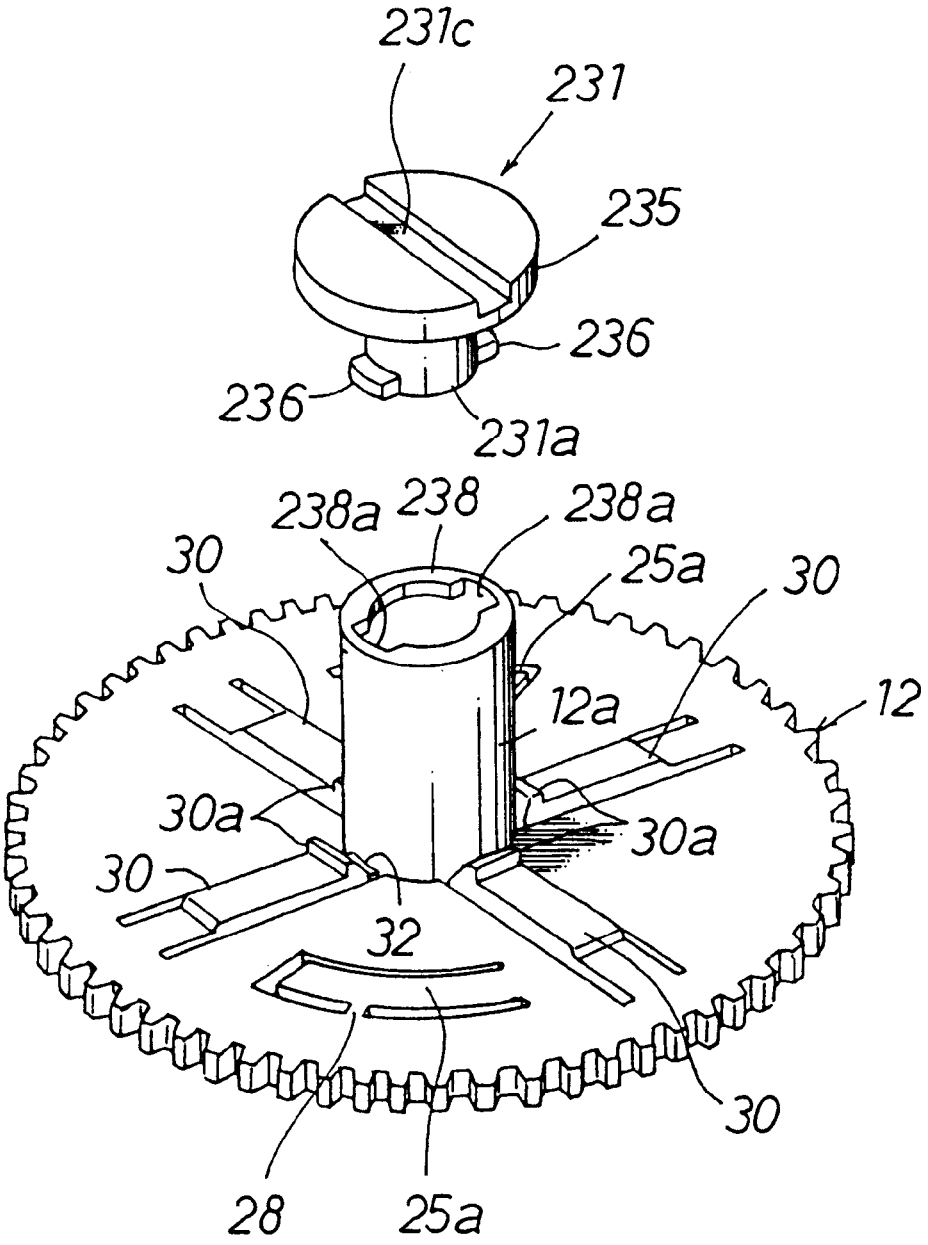
FIG. 17 is a perspective exploded view showing the relation of engaging support member and payout rotary gear in the clutch mechanism of the coat film transfer tool.
Figure 18:
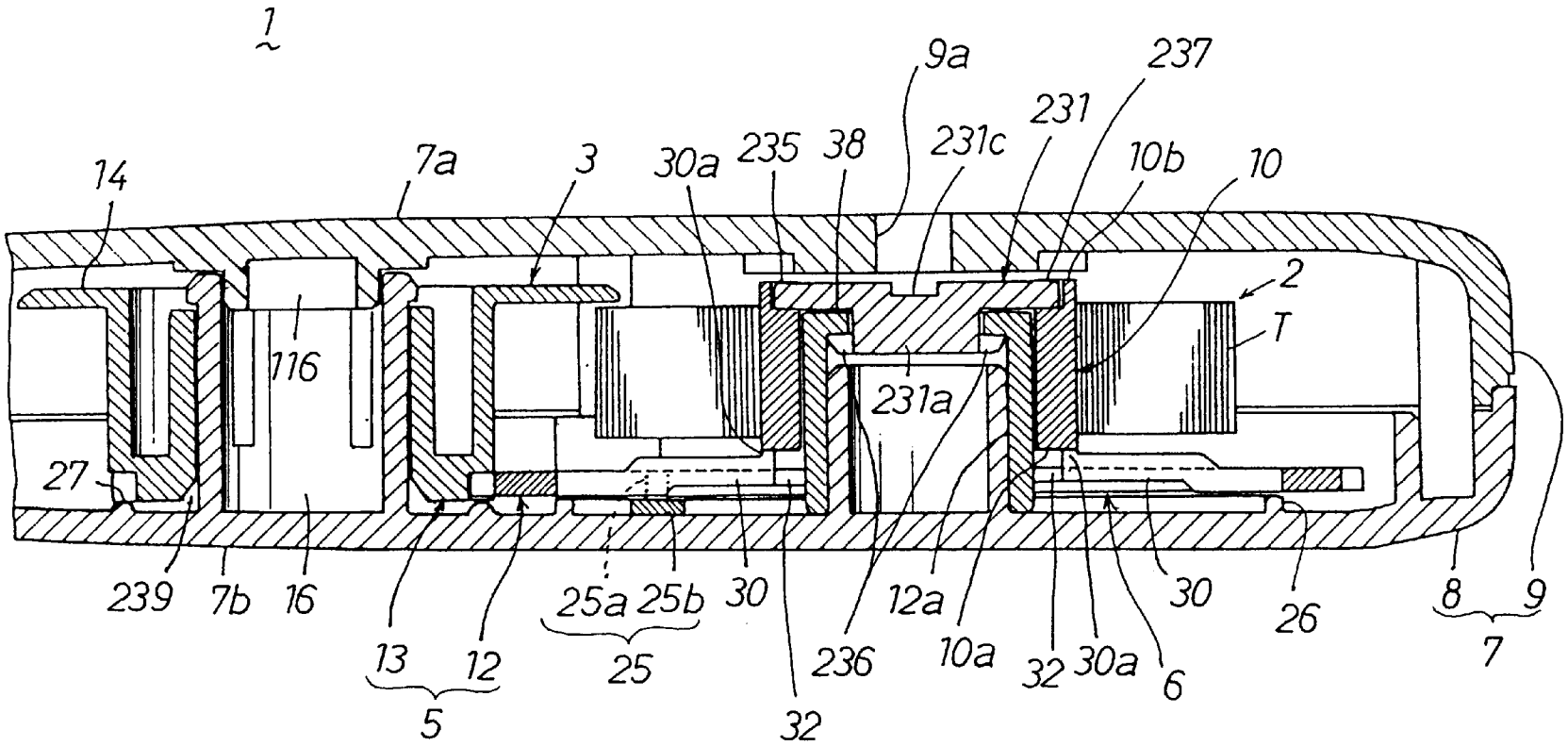
FIG. 18 is a sectional view corresponding to FIG. 2 showing the coat film transfer tool.

This embodiment is shown in FIG. 16 through FIG. 18, and relates to a refill type capable of replacing the coat film transfer tape T as consumable part, as compared with the disposable type disclosed in embodiments 1 to 7.

That is, a payout rotary gear 12 as payout rotary unit and a takeup rotary gear 13 as takeup rotary unit are rotatably mounted and supported on a hollow support shaft 15 and a hollow support shaft 16 of a case main body 8, and a payout reel 2 and a takeup reel 3 are detachably mounted on these rotary gears 12, 13. The both rotary gears 12, 13 function also as the linkage same as in embodiments 1 to 7.

More specifically, at the payout reel 2 side, the engaging support member 231 is provided detachably on the rotary shaft 12*a* of the payout rotary gear 12, so that the payout reel 2 can be replaced easily by the user.

The engaging support member 231 is in a shape and size to be put in the case 7, and thereby a penetration hole 9*a* in a cover 9 of the case 7 functions only as tape inspection hole.

An axial engaging portion 235 provided in the engaging support member 231 is in a form of an engaging flange, as shown in FIG. 17, projecting horizontally in the radial direction from the outer circumference of the engaging support member 231. By contrast, at an axial end 10*b* of the tape core 10, an engaging recess 237 is formed, and this engaging recess 237 is in a form of an annular recess to be engaged with the outer circumference of the engaging flange 235.

A detent pawl 236 is fixed and formed integrally, projecting in the radial direction, in part of a mounting cylindrical part 231*a* of the engaging support member 231, and in the illustrated example, a pair of detent pawls 236, 236 are provided. These detent pawls 236, 236 are in a form of engaging detachably with the rotary shaft 12*a* of the payout rotary gear 12. That is, in the inner circumference of the rotary shaft 12*a* of the payout rotary gear 12, annular engaging flanges 238 are disposed corresponding to the detent pawls 236, 236, and inserting recesses 238*a*, 238*a* for inserting the detent pawls 236, 236 are formed in part thereof.

After inserting the detent pawls 236, 236 into the rotary shaft 12*a*, while passing the detent pawls 236, 236 into these inserting recesses 238*a*, 238*a*, by rotating the detent pawls 236, 236 about its axial center, the detent pawls 236, 236 are engaged with the engaging flange 238 in the axial direction, and the engaging support member 231 is installed. On the other hand, by the reverse action, the engaging support member 231 can be detached from the rotary shaft 12*a*. As a result, the payout reel 2 can be detachably mounted on the payout rotary gear 12.

At the takeup reel 3 side, the tape core 11 of the takeup reel 3 is rotatably and detachably mounted on the takeup rotary gear 13 mounted on the case main body 8, by rotating direction engaging means 239 of such as serration fitting or spline fitting.

Thus, when the coat film transfer tape T of the payout reel 2 is paid out and used up completely, and all the used coat film transfer tape T' is taken up and recovered on the takeup reel 3, the both reels 2, 3 only are detached from the both rotary gears 12, 13, and are replaced with new reels 2, 3.

The other construction and action are same as in embodiment 1.

Embodiment 9

Figure 19:
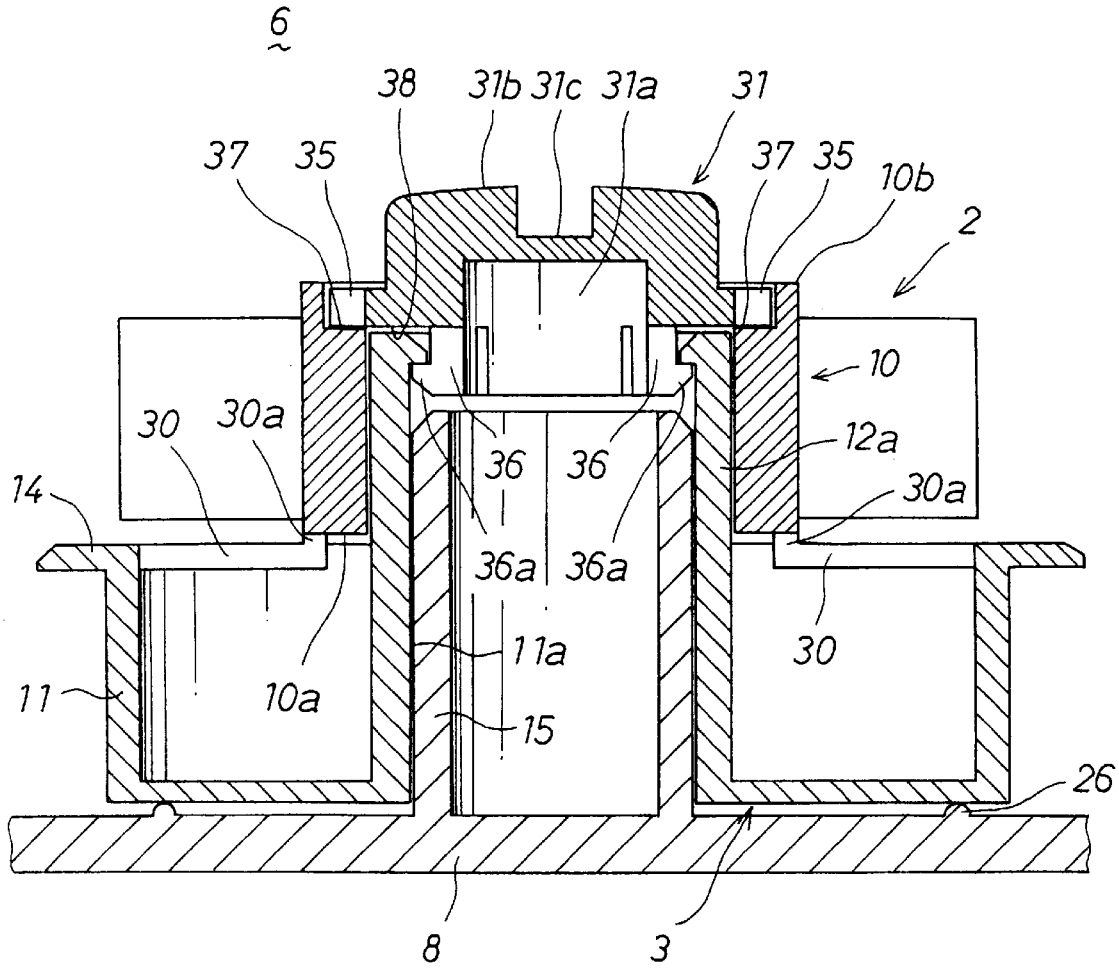
FIG. 19 is a magnified sectional view of a clutch mechanism corresponding to FIG. 3 showing a coat film transfer tool in embodiment 9 of the invention.
Figure 20A:
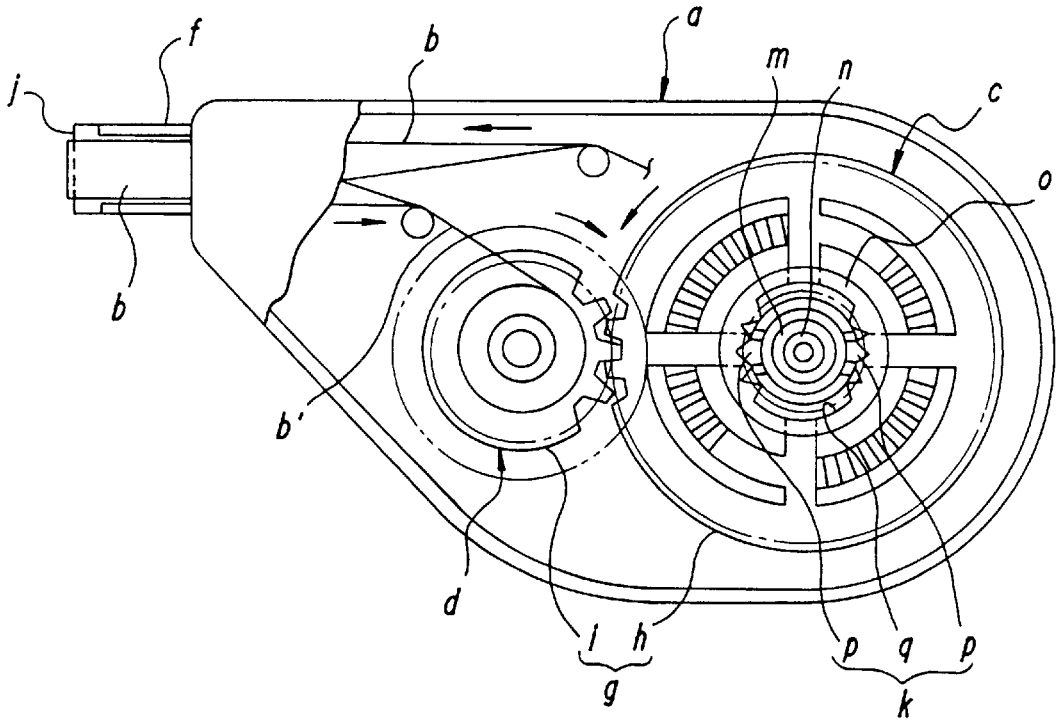
FIG.20(a) (RELATED ART)
FIG. 20(*a*) is a partially cut-away front view of a conventional coat film transfer tool.
Figure 20B:
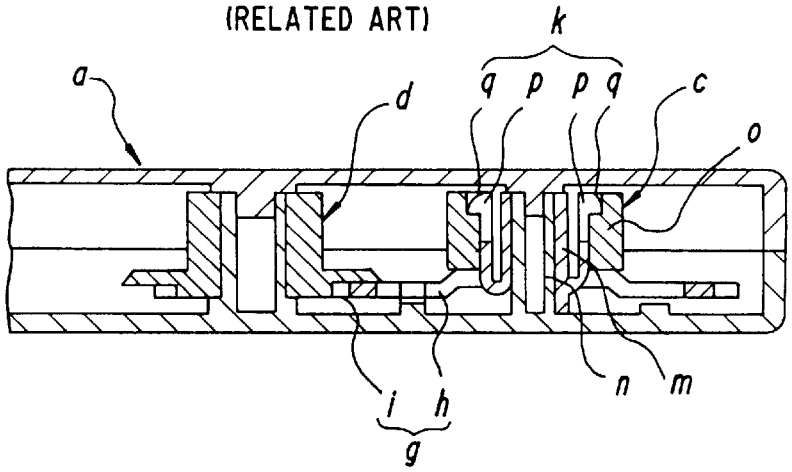
FIG.20(b) (RELATED ART)
Figure 21A:
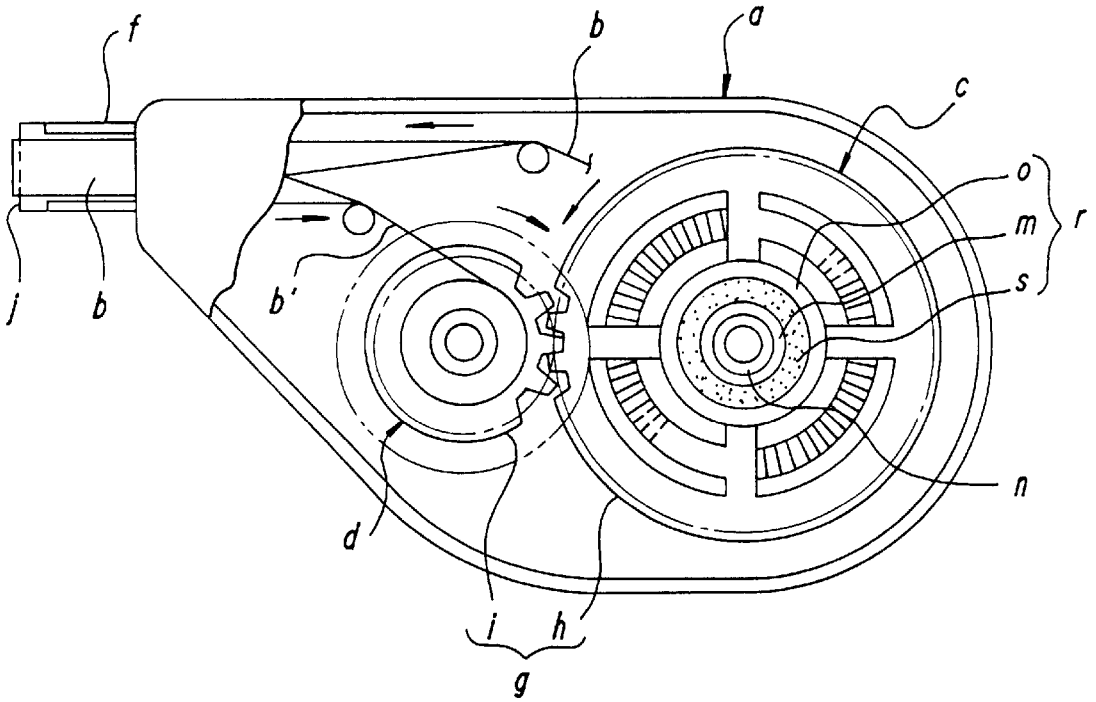
FIG.21(a) (RELATED ART)
FIG. 21(*a*) is a partially cut-away front view of other conventional coat film transfer tool.
Figure 21B:
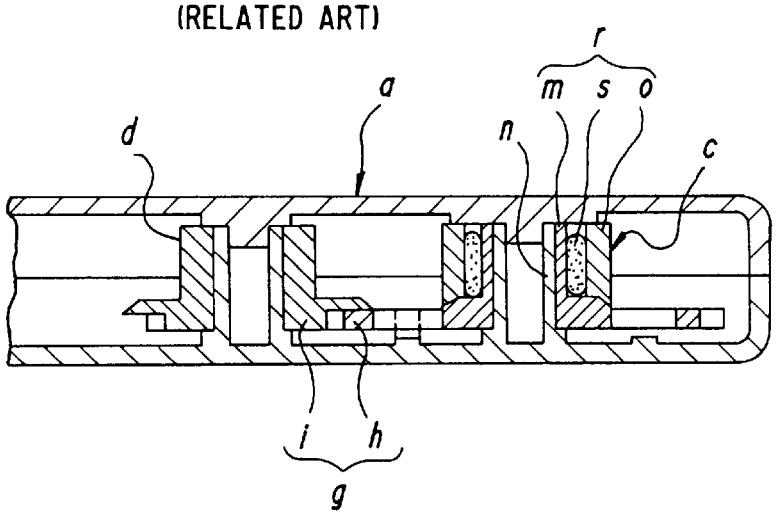
FIG.21(b) (RELATED ART)

This embodiment is shown in FIG. 19, which relates to a reel structure of one-shaft type comprising a payout reel 2 and a takeup reel 3 coaxially and rotatably relatively, as compared with the reel structure of two-shaft type comprising the payout reel 2 and takeup reel 3 rotatably supported on support shafts 15, 16 disposed independently parallel to each other as in embodiments 1 to 8.

In this embodiment, as shown in FIG. 19, the rotary shaft 11*a* at the inner side of the tape core 11 of the takeup reel 3 is extending and projecting to the upper side in the axial direction from a tape running guide flange 14, and on the outer circumference of this rotary shaft 11*a*, the tape core 10 of the payout reel 2 is coaxially and rotatably supported, and this tape core 10 and takeup reel 3 are frictionally engaged with each other by means of engaging protrusions 30, 30, . . . which are frictional engaging members of the clutch mechanism 6.

The clutch mechanism 6 composes not only the power transmitting means between the both reels 2, 3 as the intrinsic function same as in the foregoing embodiments, but also the function same as the linkage 5 in the foregoing embodiments as the rotary drive section for linking the both reels 2, 3 so as to interlock with each other.

More specifically, the plural engaging protrusions 30, 30, . . . of the clutch mechanism 6 are integrally formed at the inner side of the tape running guide flange 14 of the takeup reel 3, and their engaging portions 30*a*, 30*a*, . . . are disposed so as to project upward from the upper surface of the tape running guide flange 14 in stationary state at positions corresponding to the axial end 10*a* of the tape core 10 of the payout reel 2, and include also engaging flat planes corresponding to the flat plane of the axial end 10*a*.

A rewind button 31 as the engaging support member has its axial engaging portion 35 engaged with the axial end 10*b* of the tape core 10, and its detent pawl 36 is engaged with the rotary shaft 11*a* of the takeup reel 3. For this purpose, an engaging flange 38 is provided at the inner side of the rotary shaft 11*a* so as to be engaged with the detent pawl 36 in the axial direction.

The two reels 2, 3 thus assembled by the rewind button 31, having the rotary shaft 11*a* of the takeup reel 3 rotatably supported on the hollow support shaft 15 of the case main body 8, are rotatably provided in the case main body 8 in coaxial and relatively rotatable state. In this case, the both reels 2, 3 are prevented from being slipping out of the hollow support shaft 15 by the cover 9 assembled in the case main body 8.

With the both reels 2, 3 installed in the case 7, the coat film transfer tape T paid out from the payout reel 2 is, although not shown in the drawings, guided through a guide pin 23, and is inverted through the pressing portion 4*a* of the head 4,and is further guided through a guide pin 24, and is taken up on the takeup reel 3.

The axial lower end of the rotary shaft 11*a* of the takeup reel 3 is slidably supported on an annular rib 26 of the case main body 8.

The other construction and action are same as in embodiment 1.

The above embodiments are only preferred embodiments of the invention, and the invention is not limited to them alone, but various design changes are possible within the scope thereof. For example, the following modifications are possible.

(1) The clutch mechanism in embodiments 1 to 7 can be also applied in the refill type coat film transfer tool as in embodiment 8, and, for example, in the refill type coat film transfer tool, although not shown, a tape rewind mechanism for eliminating and removing looseness of coat film transfer tape T between the two reels 2, 3 may be provided.

(2) In embodiments 1 to 8, the clutch mechanism is disposed at the payout reel 2 side, but it may be also disposed at the takeup reel 3 side depending on the purpose, or further it may be disposed at both reels 2, 3. When the clutch mechanism is disposed at both reels 2, 3, in the rewind operation by the tape rewind mechanism, action of excessive tension on the coat film transfer tape T can be effectively prevented.

(3) The specific structure of each constituent member is not limited to the illustrate example alone, but other structures having similar functions may be employed depending on the purpose or manufacturing condition. For example, although the illustrated embodiments relate to the coat film transfer head 4 suited to lateral writing, the invention may be also applied to the coat film transfer tool suited to vertical writing type.

(4) Alternatively, instead of the corrective paint layer of the coat film transfer tape T in the illustrated coat film transfer tool, by using a paint layer presenting a transparent fluorescent color, it can be also used as a so-called marker coat film transfer tool for visually emphasizing the coat film applied position of the paint layer.

(5) As the coat film transfer tape T, by using a structure forming an adhesive on one side of a film base material through a parting agent layer, the coat film transfer tool can be used as an applicator for transferring only the adhesive layer on the sheet of paper.

As described specifically herein, according to the clutch mechanism of the invention, since the tape core and the rotary drive section are frictionally engaged with each other in the rotating direction by power transmitting means making use of the frictional force by thrust load, in its synchronizing action, each constituent member relatively slide on each other smoothly, and the sense of manipulation is favorable, and uneven running does not occur.

Besides, the frictional engaging force of the force transmitting means can be set to an optimum value by properly adjusting the engaging dimensional relation in the axial direction of the rotary drive unit and engaging support member, and setting the axial engaging forces of the two, and as compared with the prior art of making use of frictional force due to radial load, the designing and manufacturing conditions of the constituent members are loose, and the manufacture is easy and also assembling is easy, so that the manufacturing cost and device cost can be lowered.

Still more, the construction of the clutch mechanism is simple and the number of constituent parts is small, manufacturing is easy, and a high assembling precision is obtained, it is obtained at low cost, and therefore the cost of the coat film transfer tool itself can be lowered.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A clutch mechanism of a coat film transfer tool, provided in an automatic takeup type coat film transfer tool that rotates a takeup reel which recovers the coat film transfer tape after use in cooperation with a payout reel containing a roll of coat film transfer tape, a payout speed and a takeup speed of the coat film transfer tape between the payout and takeup reels, respectively, is synchronized, comprising:

a cylindrical tape core that winds the coat film transfer tape thereon;

a rotary drive unit that rotates with the cylindrical tape core; and an engaging support member that engages the rotary drive unit in an axial direction, wherein the tape core is engaged and supported from both sides in the axial direction by the rotary drive unit and engaging support member, and the tape core and rotary drive unit frictionally engage each other in a rotational direction by power transmitting means using frictional force generated by a thrust load.

2. A clutch mechanism of the coat film transfer tool of claim 1, wherein the power transmitting means comprises plural frictional engaging members elastically deformable in the axial direction, provided integrally at least with one of the rotary drive unit and engaging support member, and the frictional engaging members elastically engage an axial end of the tape core by a specified pressing force from the axial engaging force of the rotary drive unit and engaging support member.

3. A clutch mechanism of the coat film transfer tool of claim 2, wherein the rotary drive unit is disposed rotatably in a case of the coat film transfer tool, and the tape core is supported coaxially and rotatably on a rotary shaft of the rotary drive unit, the frictional engaging members of the power transmitting means are engaging protrusions formed integrally at plural positions in at least one circumferential direction of the rotary drive unit and engaging support member, and the engaging protrusions are deformable elastically in the axial direction and elastically engage a confronting flat axial end of the tape core by the specified pressing force from the axial engaging force of the rotary drive unit and engaging support member.

4. A clutch mechanism of the coat film transfer tool of claim 3, wherein the engaging protrusions of the power transmitting means are formed integrally at plural positions in the circumferential direction of the rotary drive unit and elastically engage the confronting flat axial end of the tape core by the specified pressing force from the axial engaging force of the rotary drive unit and engaging support member.

5. A clutch mechanism of the coat film transfer tool of claim 3, wherein the engaging protrusions of the power transmitting means are formed integrally at plural positions in the circumferential direction of the engaging support member and elastically engage the confronting flat axial end of the tape core by the specified pressing force from the axial engaging force of the rotary drive unit and engaging support member.

6. A clutch mechanism of the coat film transfer tool of claim 3, wherein the engaging protrusions of the power transmitting means are formed integrally at plural positions in the circumferential direction of the rotary drive unit and engaging support member and elastically engage the confronting flat axial end of the tape core by the specified pressing force from the axial engaging force of the rotary drive unit and engaging support member.

7. A clutch mechanism of the coat film transfer tool of claim 3, wherein the engaging support member includes an axial engaging portion that engages the axial end of the tape core, and a detent pawl that engages the rotary shaft of the rotary drive unit, and the engaging protrusions elastically engage the confronting flat axial end of the tape core by the specified pressing force from the engaging force corresponding to the tape core of the axial engaging portion when the detent pawl of the engaging support member is engaged with a support portion of the rotary drive unit.

8. A clutch mechanism of the coat film transfer tool of claim 7, wherein the detent pawl of the engaging support member is elastically deformable in the radial direction, and an engaging flange engages the detent pawl in the axial direction and is provided in an inner circumference of the rotary shaft of the rotary drive unit, and the detent pawl is elastically deformed along an inner side in the radial direction to pass in the axial direction, with respect to an engaging flange, and is engaged by elastic returning.

9. A clutch mechanism of coat film transfer tool of claim 7, wherein the detent pawl of the engaging support member is detachably engaged with the rotary shaft of the rotary drive unit.

10. A clutch mechanism of the coat film transfer tool of claim 7, wherein the engaging support member includes a rotary engaging portion that engages the axial end of the tape core in the rotating direction, and a rotary manipulating unit for rewind rotary manipulation.

11. A clutch mechanism of the coat film transfer tool of claim 10, wherein the axial engaging portion of the engaging support member is formed as an engaging bump that engages engaging recess formed in the axial end of the tape core, and also functions as the rotary engaging portion.

12. A coat film transfer tool of a disposable type coat film transfer tape comprising:

a case having a shape and size that is holdable and manipulatable by one hand of a user;

a payout reel provided rotatably in the case, the payout reel contains a roll of coat film transfer tape;

a takeup reel provided rotatably in the case, the takeup reel recovers the coat film transfer tape after use;

a linkage that interlocks the payout and takeup reels so as to operate with each other;

a coat film transfer head projecting from a leading end of the case, the coat film transfer head presses the coat film transfer tape on a transfer area; and a clutch mechanism disposed at least in one of the payout and takeup reels that synchronizes a payout speed and a takeup speed of the coat film transfer tape between the payout and takeup reels, wherein the clutch mechanism includes a cylindrical tape core that winds the coat film transfer tape thereon, a rotary drive unit that rotates with the cylindrical tape core, and an engaging support member that engages the rotary drive unit in an axial direction, and the tape core is engaged and supported from both sides in the axial direction by the rotary drive unit and engaging support member, and the tape core and rotary drive unit frictionally engage each other in a rotational direction by power transmitting means using frictional force generated by a thrust load.

13. A coat film transfer tool of claim 12, wherein the power transmitting means comprises plural fictional engaging members elastically deformable in the axial direction, the fictional engaging members being integral at least with one of the rotary drive unit and engaging support member, and the frictional engaging members elastically engage the axial end of the tape core by a specified pressing force from the axial engaging force of the rotary drive unit and engaging support member.

14. A coat film transfer tool of claim 12, wherein each of the payout reel and takeup reel have a two-shaft type reel structure that is rotatably supported on parallel support shafts that are disposed independently of each other.

15. A coat film transfer tool of claim 12, wherein each of the payout reel and takeup reel have a one-shaft type reel structure that is disposed coaxial and rotate relative to each reel.

16. A coat film transfer tool of claim 12, further comprising:

a tape rewind mechanism that eliminates and removes looseness of coat film transfer tape between the payout and takeup reels, wherein the tape rewind mechanism has the engaging support member of the clutch mechanism disposed opposite to an outside of the case and a rotary manipulating portion that forms rewind rotating manipulation at an outer end of the engaging support member.

17. A coat film transfer tool of a refill type coat film transfer tape comprising:

a case having a shape and size that is holdable and manipulatable by one hand of a user;

a payout rotary unit provided rotatably in the case;

a takeup rotary unit provided rotatably in the case;

a linkage that interlocks the payout and takeup rotary units so as to operate with each other;

a payout reel that is detachably engaged and integrally rotates with the payout rotary unit and contains a roll of coat film transfer tape;

a takeup reel that is detachably engaged and integrally rotates with the takeup unit the takeup reel recovers the coat film transfer tape after use;

a coat film transfer head projecting at a leading end of the case, the coat film transfer head presses the coat film transfer tape on a transfer area; and a clutch mechanism disposed at least in one of the payout and takeup reels, the clutch mechanism synchronizes a payout speed and takeup speed of the coat film transfer tape between the payout and takeup reels, wherein the clutch mechanism includes a cylindrical tape core that winds the coat film transfer tape thereon, a rotary drive unit that rotates with the tape core, and an engaging support member that engages the rotary drive unit in an axial direction, and the tape core is held and supported from both sides in the axial direction by the rotary drive unit and engaging support member, and the tape core and rotary drive unit frictionally engage each other in a rotational direction by power transmitting means using frictional force generated by a thrust load.

18. A coat film transfer tool of claim 17, wherein the power transmitting means comprises plural frictional engaging members elastically deformable in the axial direction, the frictional engaging member being integral at least with one of the rotary drive unit and engaging support member, and the frictional engaging members elastically engage an axial end of the tape core by a specified pressing force from the axial engaging force of the rotary drive unit and engaging support member.

19. A coat film transfer tool of claim 17, wherein each of the payout reel and takeup reel have a two-shaft type reel structure that is rotatably supported on parallel support shafts that are disposed independently of each other.

20. A coat film transfer tool of claim 17, wherein each of the payout reel and takeup reel have a one-shaft type reel structure that is disposed coaxial and rotate relative to each reel.

21. A coat film transfer tool of claim 17, further comprising:

a tape rewind mechanism that eliminates and removes looseness of coat film transfer tape between the two reels, wherein the tape rewind mechanism has the engaging support member of the clutch mechanism disposed opposite to an outside of the case and a rotary manipulating portion that forms rewind rotating manipulation at an outer end of the engaging support member.

* * * * *